US006886620B2

(12) United States Patent
Cohen-Ravid et al.

(10) Patent No.: US 6,886,620 B2
(45) **Date of Patent: *May 3, 2005**

(54) SECURITY BAR ASSEMBLY

(76) Inventors: Moshe Cohen-Ravid, 1120-595 Howe St., Vancouver, B.C. (CA), V6C 2T5; John A. Lane, 308-8495 Ontario St., Vancouver, B. C. (CA), V5X 3E8

( * ) Notice: Subject to any disclaimer, the term of this patent is extended or adjusted under 35 U.S.C. 154(b) by 0 days.

This patent is subject to a terminal disclaimer.

(21) Appl. No.: 10/164,061

(22) Filed: Jun. 5, 2002

(65) Prior Publication Data

US 2003/0019587 A1 Jan. 30, 2003

Related U.S. Application Data

(63) Continuation-in-part of application No. PCT/CA2001/000330, filed on Mar. 13, 2001, which is a continuation-in-part of application No. 09/524,089, filed on Mar. 13, 2000, now Pat. No. 6,394,167, which is a continuation-in-part of application No. 08/820,847, filed on Mar. 20, 1997, now Pat. No. 6,035,917.

(51) Int. Cl.[7] ..... E04F 10/08
(52) U.S. Cl. ..... 160/32; 160/188
(58) Field of Search ..... 160/32, 33, 35, 160/36, 37, 133, 188, 189, 201, 405

(56) References Cited

U.S. PATENT DOCUMENTS

| | | | |
|---|---|---|---|
| 343,956 | A | 6/1886 | Holmes |
| 813,631 | A | 2/1906 | Elmquist |
| 1,597,392 | A | 8/1926 | Rorabeck |
| 2,057,850 | A | 10/1936 | Sims |
| 2,095,690 | A | 10/1937 | Brunst |
| 2,423,987 | A | 7/1947 | Levikow |
| 2,672,192 | A | 3/1954 | Goldner |
| 2,882,045 | A | 4/1959 | Moore |

(Continued)

FOREIGN PATENT DOCUMENTS

| | | |
|---|---|---|
| CH | 258795 | 5/1949 |
| DE | 866843 | 1/1952 |
| EA | 001858 | 8/2001 |
| EP | 0 248 837 | 9/1989 |
| EP | 0 756 062 A1 | 1/1997 |
| FR | 506153 | 8/1920 |
| FR | 2 747 152 | 4/1996 |
| SG | 68134 | 10/2001 |
| WO | 95/13451 | 5/1995 |
| WO | 98/42942 | 10/1998 |

*Primary Examiner*—David Purol
(74) *Attorney, Agent, or Firm*—Fulbright & Jaworski L.L.P.

(57) ABSTRACT

A security bar assembly has a plurality of bars that extend across an opening and have ends joined to drive chains. The bars may extend between two channels positioned on opposite faces of the opening, and may be slidable within the channels. The ends of the bars may be retained in the channels and the ends may have connections to chain links in opposing drive chains which are spaced apart a predetermined number of links to keep the bars a predetermined distance apart. A drive mechanism may be provided for moving the drive chains to slide the bars in the channels and a storage area adjacent the opening associated with the channels to retain the bars when they are not in place over the opening. The channels may each enclose a drive mechanism for independently moving the bar ends in each channel. In such embodiments, the drive mechanisms in the channels may be independently driven respectively by first and second motors. The first and second motors may be synchronized by a non-mechanical communication link. Transfer mechanisms are provided for moving the security bars between a stored position and a position in which the bars engage the bar drive chain.

32 Claims, 22 Drawing Sheets

U.S. PATENT DOCUMENTS 3,103,246 A 9/1963 Brodsky
3,289,350 A 12/1966 Moody
3,389,740 A 6/1968 Buehler
3,601,175 A 8/1971 Wardlaw
3,738,413 A 6/1973 Frobosilo et al.
3,739,832 A 6/1973 Sivin
3,842,891 A 10/1974 Kinnroth et al.
3,850,465 A 11/1974 Hill et al.
3,955,661 A 5/1976 Popper et al.
4,139,042 A 2/1979 Watanabe et al.
4,282,920 A 8/1981 Kremm
4,379,478 A 4/1983 Lichy
4,662,420 A 5/1987 Hirao
4,838,331 A 6/1989 Kasai
4,953,608 A 9/1990 Larsson
5,044,417 A 9/1991 Bresson
5,065,806 A 11/1991 Kondoh
5,139,075 A 8/1992 Desrochers
5,172,742 A 12/1992 Iwasaki et al.
5,211,440 A 5/1993 Cramaro
5,222,403 A 6/1993 Angelini et al.
5,373,887 A 12/1994 Glover
5,469,905 A 11/1995 McKinney et al.
5,957,181 A 9/1999 Cohen-Ravid et al.
6,035,917 A 3/2000 Cohen-Ravid
6,394,167 B1 * 5/2002 Cohen-Ravid et al. ..... 160/32

* cited by examiner

SECURITY BAR ASSEMBLY

CROSS REFERENCES TO RELATED APPLICATIONS

This application is a continuation in part of PCT International Application No. PCT/CA2001/000330 filed Mar. 13, 2001, designating the United States, which is a continuation-in-part of application Ser. No. 09/524,089 filed Mar. 13, 2000, now issued as U.S. Pat. No. 6,394,167, which is a continuation-in-part of application Ser. No. 08/820,847 filed Mar. 20, 1997, now issued as U.S. Pat. No. 6,035,917.

FIELD OF THE INVENTION

The present invention relates to a security bar assembly for a window or door opening in a building.

BACKGROUND OF THE INVENTION

There is a requirement for security bars to be used in front of windows and doors and particularly in front of storefronts and the like. Such security bars are needed to deter break-in attempts into a building. There are various types of security bars and shutters available. For example, U.S. Pat. Nos. 5,957,181 and 6,035,917 (Cohen-Ravid) disclose security bar assemblies that have a plurality of bars extending across an opening. The bars have ends that may be joined to drive chains. The bar ends may be connected to chain links that have inserts disposed therein which cooperate with the end portions of the bars to drive the chain. Transport mechanisms may be used to move the drive chain such that the bars slide, and therefore cover, the opening.

SUMMARY OF THE INVENTION

The present invention provides a security bar assembly for an opening including a plurality of bars extending between two channels, the two channels positioned on opposite faces of the opening. The bars may be slidable within the channels, having bar ends retained in the channels. The channels may optionally have bar drive chains having adjoining chain links guided within the two channels, or other transport mechanisms such as drive shafts. Each of the bars may have a connection at each end to engage a chain link in the drive chain. The engaged chain links may be spaced apart a predetermined number of chain links in each of the drive chains to retain the bars a predetermined distance apart. A drive mechanism may be provided for moving the bars at substantially the same speed to slide the bars in the channels over the opening. The channels may each enclose a drive mechanism for independently moving the bar ends in each channel. In such embodiments, the drive mechanisms in the channels may be independently driven respectively by first and second motors. The first and second motors may be synchronised by a non-mechanical communication link.

A storage area may be provided adjacent the opening associated with the channels to retain the bars when they are not in place over the opening. Transfer mechanisms may be provided for moving the security bars between a stored position and a position in which the bars engage the bar transport mechanisms.

The present invention also provides a method of forming a security bar assembly in an opening including a plurality of security bars, the bars having retained ends extending between two channels on opposing faces of the opening and slidable therein, including the steps of moving drive chains in guides within the two channels, the drive chains having adjoining chain links; feeding opposing retained ends of a first bar to engage in first chain links of the drive chains so the first bar slides across the opening; feeding a second bar to engage in second chain links spaced a predetermined number of chain links from the first chain links, and continuing moving the drive chains and engaging further bars in further chain links spaced the predetermined number of chain links apart until the security bar assembly covers the opening.

There is also provided in the present invention a method of forming a security bar assembly in an opening including a plurality of security bars having retained ends engaged in chain links of drive chains guided in two channels on opposite faces of the opening and slidable therein, including the steps of moving the drive chains in guides within the two channels until a first bar having ends engaged in first chain links of the drive chains slides across the opening; continuing moving the drive chains in the guides until a second bar having ends engaged in second chain links of the drive chains slides across the opening, and further moving the drive chains with further bars engaged in further chain links until the security bar assembly covers the opening.

There is also provided in the present invention a security bar assembly for an opening including a plurality of security bars driven by a bar drive chain and a storage drive chain and a transfer mechanism including a transfer arm for moving bars between the bar drive chain and the storage drive chain.

The present invention also provides a transfer mechanism for a security bar assembly, wherein the security bar assembly includes security bars driven by a bar drive chain, wherein the transfer mechanism includes cam-like side plates on the bar drive chain, and at least one of the cam-like side plates are adapted to engage a security bar.

There is also provided in the present invention a security bar assembly for an opening, including a plurality of bars extending between first and second channels. The first and second channels may be positioned one on each of a first and second opposing side of the opening, the bars having bar ends connected to transport mechanisms for movement in each channel. The security bar assembly may further include a storage area for storing bars that are not in place over the opening, and a transfer mechanism for moving the bars from the storage area into engagement with the transport mechanisms, wherein the transfer mechanism includes a cam supporting the bar ends and having a recess adapted for accommodating a bar end to feed the bar end on to the transport mechanisms.

BRIEF DESCRIPTION OF THE DRAWINGS

In drawings which illustrate embodiments of the present invention.

DETAILED DESCRIPTION OF ALTERNATIVE EMBODIMENTS

Figure 1:
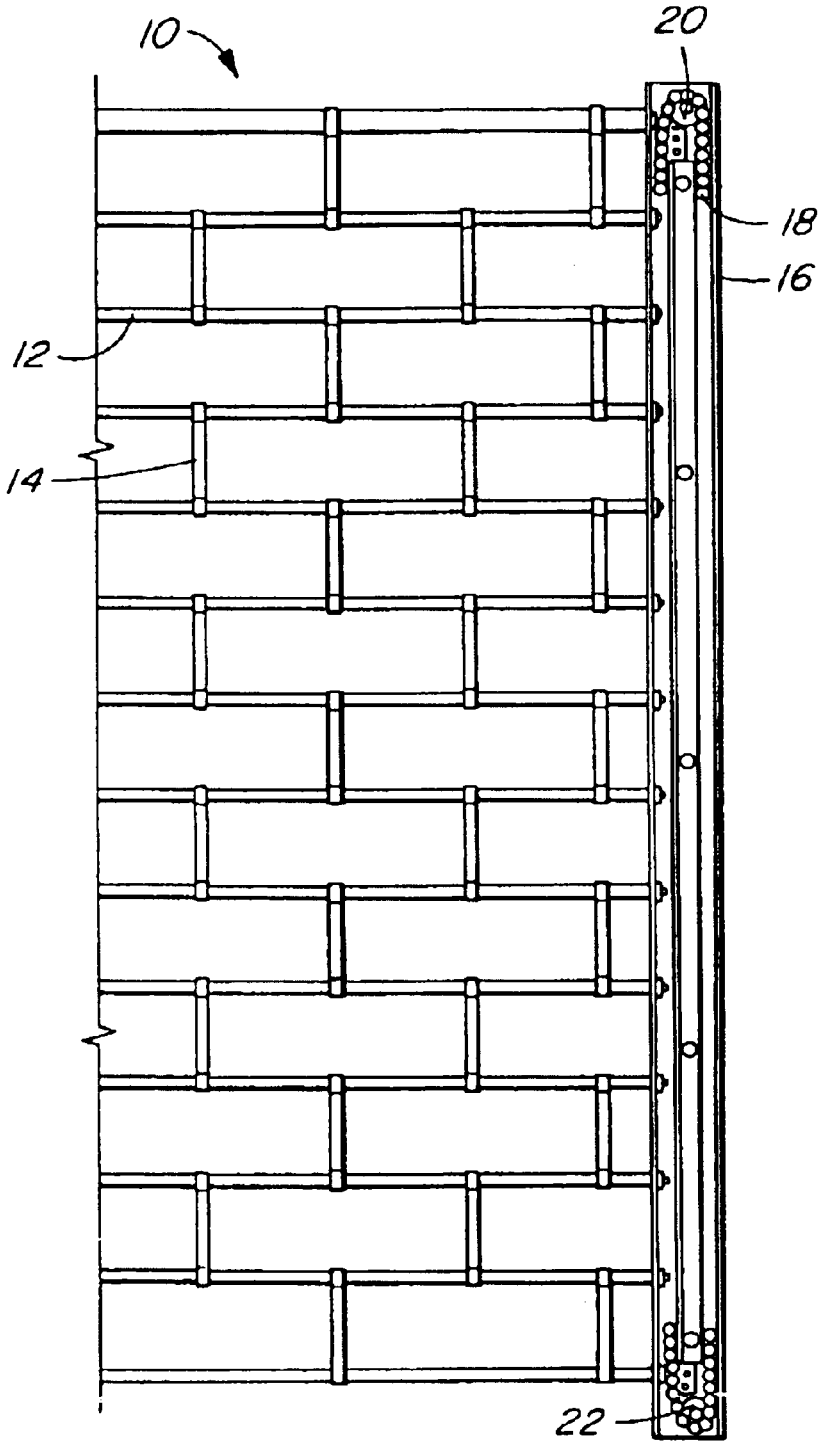
FIG. 1 is a front elevational view showing one embodiment of a portion of a security bar assembly with a drive chain in a side channel.

A security bar assembly 10 is shown in FIG. 1 with a plurality of bars 12 spaced apart by connecting links 14 which are interspaced between adjacent bars 12.

The connecting links 14 for two adjacent bars 12 are interspaced between connecting links 14 joined to bars above and below the two adjacent bars 12. The ends of each bar 12 are inserted into channels 16, each of which has a transport mechanism, for example, in this embodiment, the transport mechanism may by a drive chain 18 which moves on a first sprocket 20 and a second sprocket 22.

Figure 2:
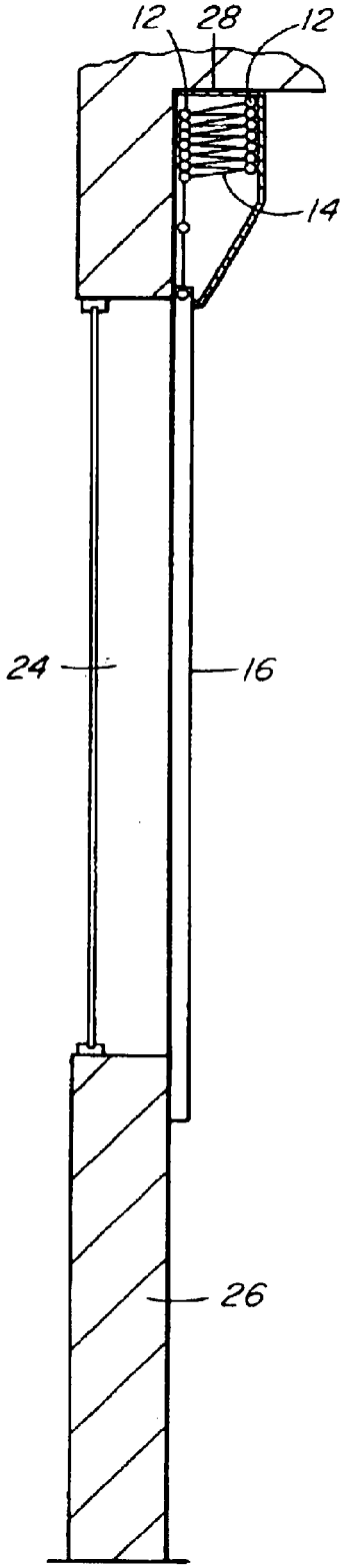
FIG. 2 is a side sectional view showing a side channel and container for holding bars with connecting links in a stored configuration above an opening.
Figure 3:
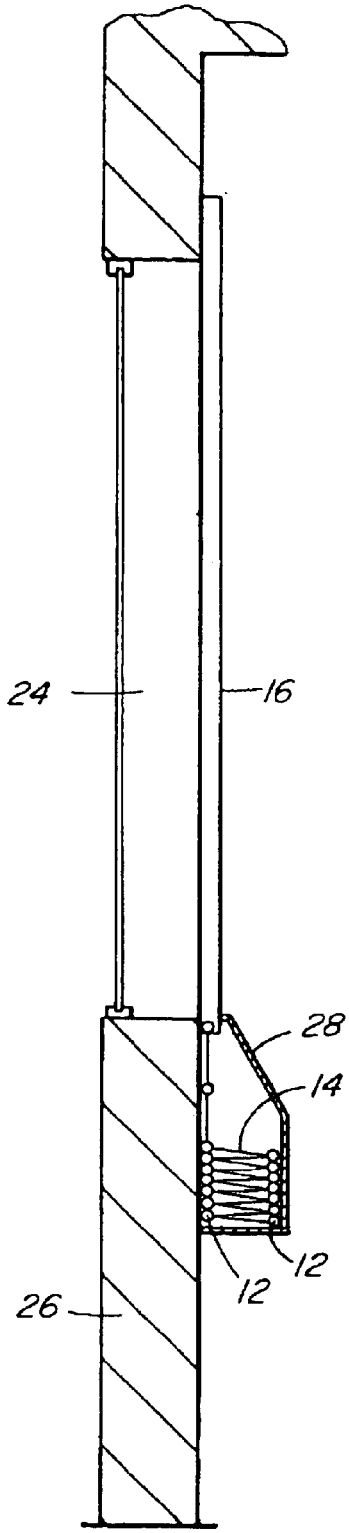
FIG. 3 is a side sectional view showing a side channel and container for holding bars with links in a stored configuration below an opening.

FIG. 2 shows a section of a security bar assembly 10 positioned in front of an opening 24 in a wall 26. A storage area such as a container 28 is shown above the opening 24 and folded security bars 12 with connecting links 14 are shown in the container 28. FIG. 3 shows a similar sectional view of a security bar assembly to that shown in FIG. 2, the difference being that the container 28 is positioned below the opening 24. In a further alternative embodiment of the storage arrangement, bars 12 may be collected on a spool above or below the opening.

Figure 4:
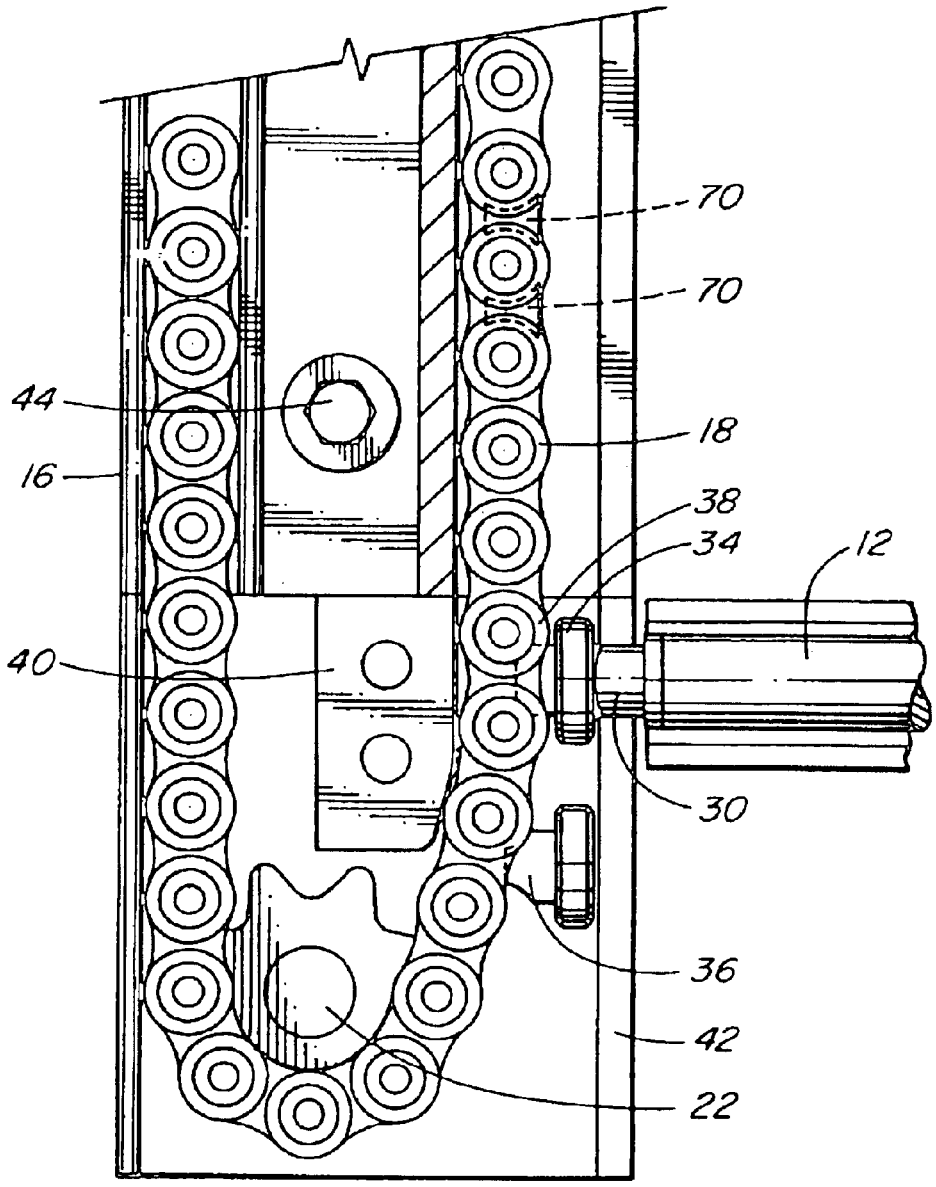
FIG. 4 is a detailed front view showing a drive chain and sprocket for engaging ends of bars.

As shown in FIGS. 2 and 3, the connecting links 14 between bars 12 may span the entire distance between adjacent bars 12. Alternatively, a drive chain 18 with multiple sections or flexible links between bars 12 may be used. Multiple links 14 may be positioned across the opening, as shown in FIG. 1, or links 14 may be located in channels 16 at either side of the opening (not shown). Details of the drive chain 18 are shown in FIG. 4 rotating about the second sprocket 22 which has an axis of rotation projecting from the wall substantially perpendicular to the bars 12. Each bar 12 has at either end a projection 30 which passes through a side slot 32 (shown in FIG. 5) in the side of the channel 16. The projection 30 has a disk member 34 to retain the end of the bar 12 within the channel 16 and has an end piece 36 that extends to fit in an aperture of a chain link 38 of the drive chain 18. A chain guide 40 in a lower channel housing 42 acts to push the drive chain 18 away from the sprocket 22 so that the end piece 36 of each of the bars 12 do not interfere with the teeth of the sprocket 22 when engaging or disengaging the chain. The channels 16 may be held to the wall beside the opening 24 by bolts 44 and each may include a cover 46, shown in FIG. 5, extending over the channel 16.

As the channel 16 is preferably placed on the inside of the building, the cover 46 and bolts 44 may be adapted so as to only be reachable from the inside of the building in such embodiments.

Figure 6:
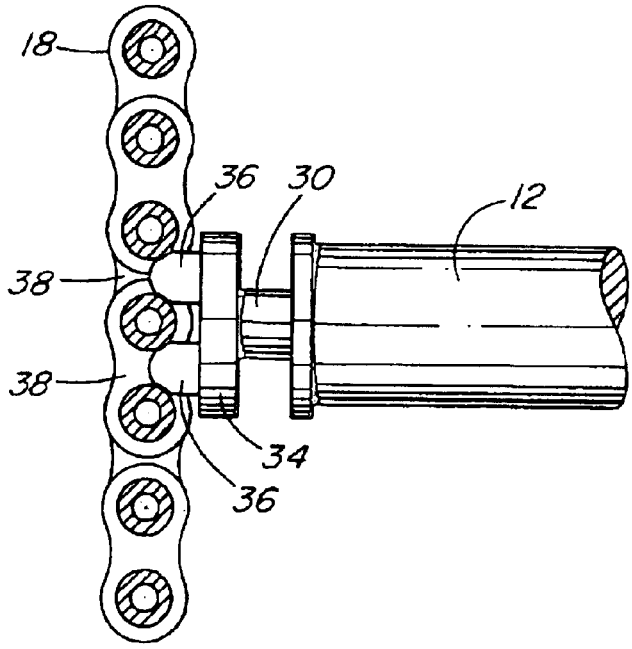
FIG. 6 is a detailed sectional front view showing another embodiment of a connection between a bar and a drive chain.

A multiple tooth connection is shown in FIG. 6 wherein the disk member 34 on the projection 30 of the bar 12 has two end pieces 36 that are spaced apart the exact distance so that they engage in adjacent apertures between chain links 38. The two end pieces 36 prevent the bar 12 from rotating.

Figure 5:
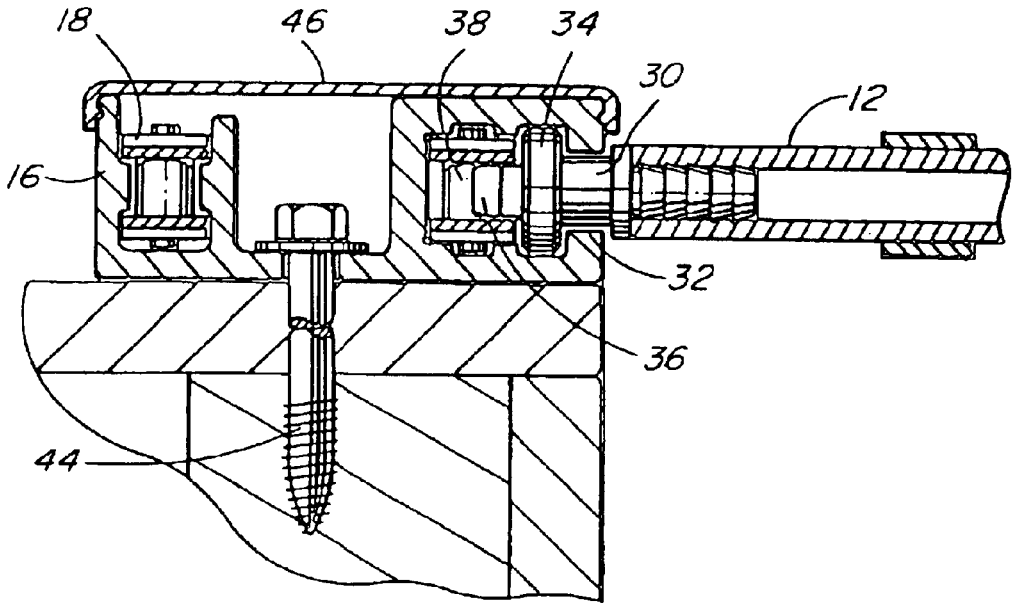
FIG. 5 is a detailed sectional top view showing a drive chain in a channel guide connected to a bar across an opening.
Figure 7:
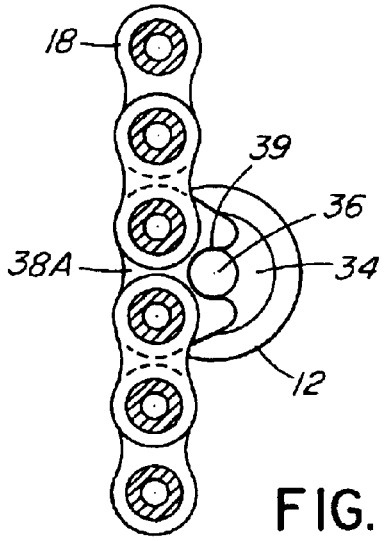
FIG. 7 is a detailed sectional side view showing a further embodiment of a connection between a bar and a drive chain.

Whereas FIGS. 4, 5 and 6 show the drive chains 18 with sprocket axes substantially at right angles to the bars 12, FIG. 7 shows another embodiment wherein the sprocket axes are substantially parallel to the bars 12. A modified chain link plate 38A is shown with an engagement groove 39 spaced away from the drive chain 18. The end piece 36 of the bar 12 fits within the engagement groove 39 and holds the bar 12 as though it were held in the chain link in the manner shown in FIGS. 4, 5 and 6. The drive chain 18 and sprockets 20,22 are then turned through 90 degrees so that the channels 16 can be placed in the sides of an opening.

Figure 8:
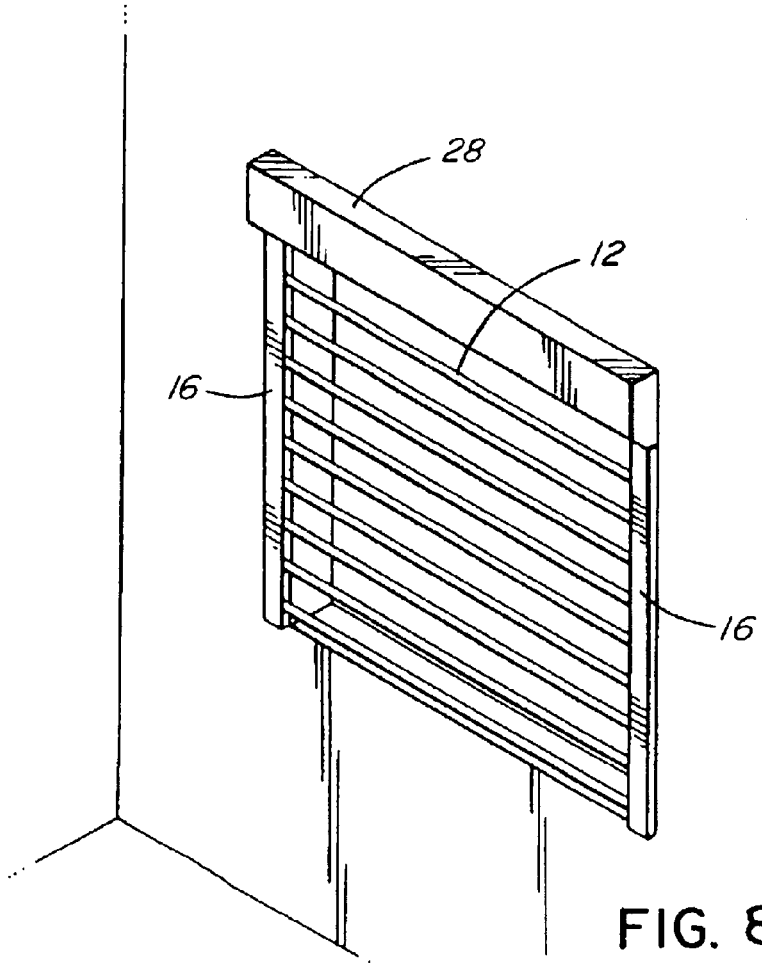
FIG. 8 is a perspective view showing bars connecting to side channels with an upper container to store the raised bars above the opening.
Figure 9:
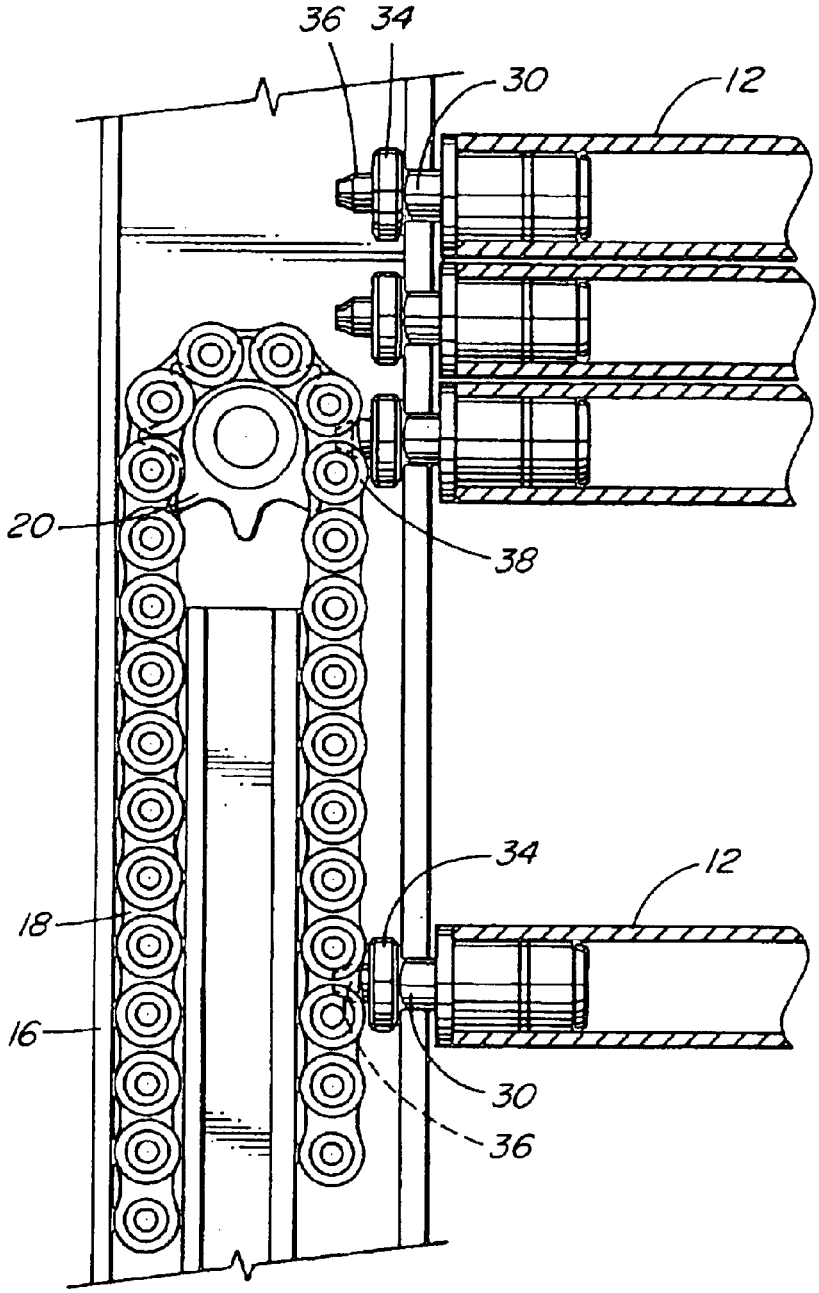
FIG. 9 is a detailed front elevational view showing the ends of bars joined to chain links and stored in a container above the opening.
Figure 10:
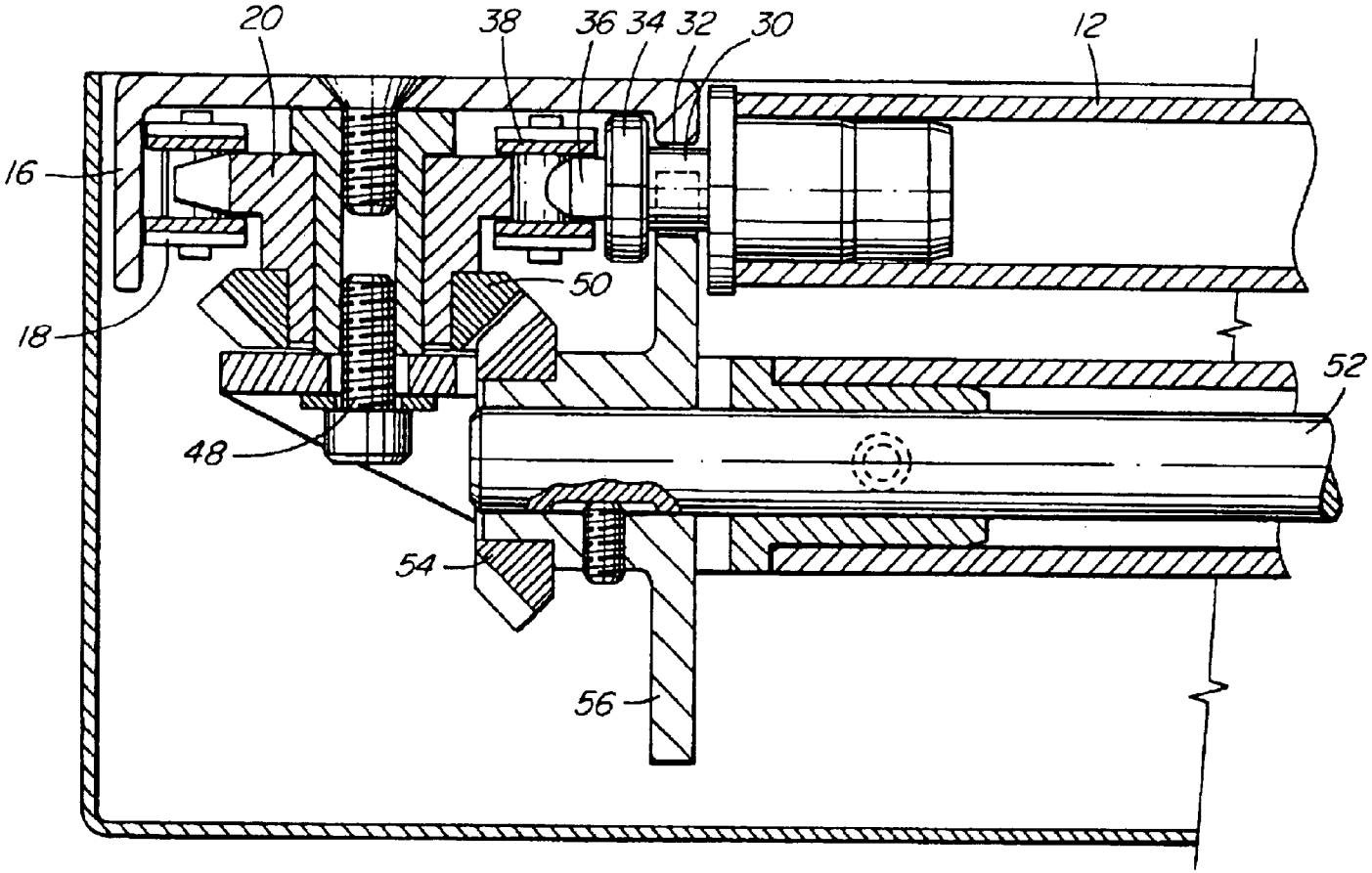
FIG. 10 is a detailed sectional top view showing an escapement mechanism for ensuring bars from an upper container engage with chain links a predetermined distance apart on a drive chain.
Figure 11:
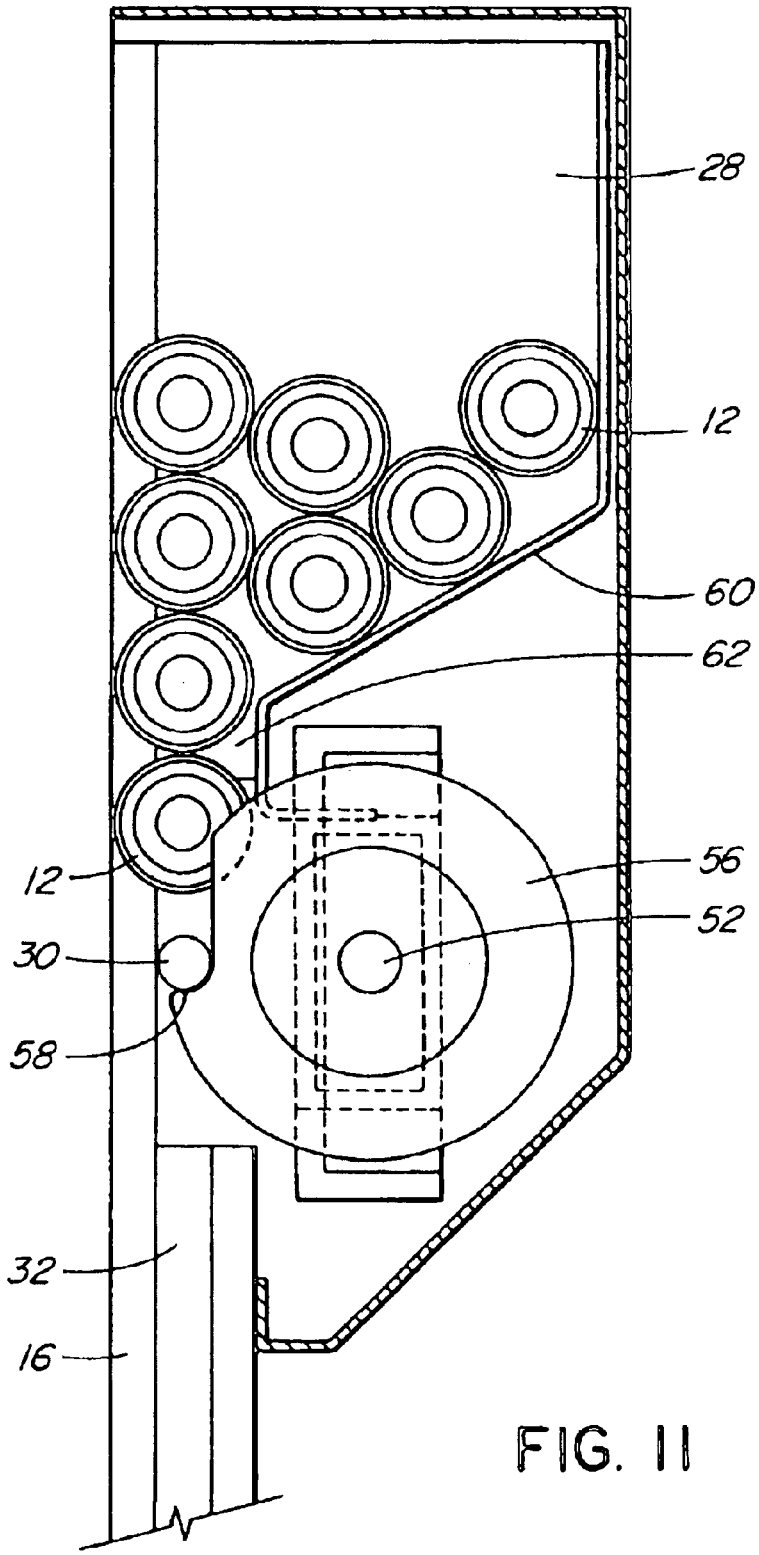
FIG. 11 is an end view showing a container above an opening with bars and the escapement mechanism for feeding the bars into opposing chain links of drive chains on both sides of an opening.

Whereas FIG. 1 shows connecting links 14 between bars 12, FIG. 8 is a perspective view showing a security bar assembly with bars 12 and no connecting links joining the bars 12 together. This may be preferable where the opening is not too wide and the bars 12 cannot therefore easily be pried apart. FIGS. 9, 10 and 11 illustrate one possible mechanism for the security bar assembly shown in FIG. 8. The drive chain 18 as shown in FIG. 9 rotates on the first sprocket 20 which is an eight tooth drive sprocket having one tooth missing. Every time the first sprocket 20 rotates and the missing tooth is open, the end piece 36 of the projection 30 from each bar 12 engages in an aperture of a chain link 38 and is then conveyed across the opening as the drive chain 18 moves around the sprocket 20. The missing tooth on the sprocket 20 is shown more clearly in FIG. 10 with the end piece 36 engaging in a chain link 38 of the drive chain 18.

Such an arrangement may be used as an alternative to the truncated tooth arrangement described elsewhere herein or to the chain guide 40 of FIG. 4. The first sprocket 20 rotates on axle 48 which in turn is driven by a driven bevel gear 50. A drive shaft 52 may extend across the opening between the two drive chains 18. While not shown, the drive shaft 52 may be driven by a gear motor that can rotate in either direction to slide the bars 12 across the opening. On either end of the drive shaft 52 is a drive bevel gear 54 that engages the driven bevel gear 50 on the axle 48 to drive the first sprocket 20. Thus, rotation of the drive shaft 52 rotates both first sprockets 20 on either side of the opening in the channels 16 and moves the chains 18 at exactly the same speed so that the bars 12 remain substantially evenly spaced apart when they are engaged in individual chain links of the drive chain 18.

In alternative embodiments, the drive chains 18 on opposite sides of the opening may be independently driven. The channels may each enclose a drive mechanism for independently moving the bar ends in each channel. In such embodiments, the drive mechanisms in the channels may be independently driven respectively by first and second motors. The first and second motors may be synchronised by a non-mechanical communication link such as a communications link mediated by acoustic, electric, or electromagnetic media which may include a transmitter and a receiver of information passed between motors, or other non-mechanical links for synchronising motors (for control circuits, see for example Electric Motor Control 6th Ed., Walter N. Alerich and Herman, ISBN: 0827384564, Delmar Thomson Learning, September 1998, incorporated herein by reference).

In some embodiments, separate channel drive mechanisms having a non-mechanical synchronisation linkage may for example be preferred to facilitate installation of bars 12 in openings of variable width, where a non-mechanical linkage may be more easily adaptable to accommodate different opening spans. The non-mechanical synchronising linkage may therefore act in some embodiments in concert with bars of adjustable length, so that security bar assemblies or security barriers of the invention are more easily adapted for installation in openings of variable width, and are able in operation to accommodate changes in the width of the opening (caused for example by structural changes in a building, such as may be associated with an attempt to break into the building). The security barriers of the invention may also be adapted to include two or more spans of security bars 12 with channels joining each span. Such spans need not be arranged linearly, so that the security barrier assemblies of the invention may be adapted to fit openings that are not planar, such as bay windows and the like.

The end piece 36 of projection 30 from each bar 12 may be conveyed into engagement with a drive chain link 38 by means of an escapement wheel 56 as shown in FIG. 11. An escapement wheel 56 is attached to the drive bevel gear 54 and has a notch 58 to engage the projection 30 of a bar 12. Initially the bars 12 are stored in a stored configuration which in the embodiment shown is a container 28 above the opening and positioned above the cross shaft 52. A guide strip 60 guides the bars 12 into a slot 62 where they individually fall. As the escapement wheel 56 rotates the projection 30 of the first bar 12 is engaged by the notch 58 which moves the bar 12 down until the end piece 36 of the bars 12 engages in the aperture of a chain link 38 that is positioned on the sprocket 20 at the location where the tooth is missing. This applies for both sprockets 20 for both drive chains 18 on either side of the opening. As the drive chains 18 move downward, the projections 30 of the bars 12 fit into the slots 32 of the channels 16. The escapement wheel 56 continues to rotate until it picks up a second bar 12 and lowers the second bar into the slots 32 of the channels 16 (FIG. 5), at the same time each end piece 36 of the bars 12 fits into an aperture of a chain link 38 at the missing tooth position on the sprocket 20. This continues until all of the bars 12 are spaced apart across the opening 24. For an eight tooth sprocket 20, the end piece 36 will engage in every eighth chain link. In one embodiment an eight tooth drive sprocket with one tooth missing provides 4" spacing for the bars. In a further embodiment the speed of the drive chain 18 represents 2" per second both up and down.

When raising the bars, the drive chain 18 moves in the opposite direction as does the escapement wheel 56. The notch 58 in the escapement wheel 56 picks up the projections 30 of each bar 12 and disengages the end piece 36 from the drive chain 18. The bar 12 is raised and pushed into the container 28 pushing other bars upwards. The container 28 is preferably lined with soft material to reduce the noise of the bars 12. As the bars 12 move upwards they spread out to take up the space of the container 28.

Whereas the mechanism shown in FIGS. 9, 10 and 11 illustrates the container 28 being on top of the opening, in another embodiment the container 28 may be positioned below the opening. The same mechanism as is illustrated would be used for feeding individual horizontal bars 12 to engage with the chain 18. However, there is a spring mechanism (not shown) provided to push each horizontal bar 12 up to ensure that each of the projections 30 engages in the notch 58 of the escapement wheel 56. In further embodiments, the security bar assembly may have the bars 12 substantially vertical, with the channels 16 and drive chains 18 at top and bottom. In this configuration, the engagement of the bars 12 in the drive chains 18 does not rely on gravity.

When connecting links 14 join the bars together, the escapement wheel is not essential providing that the first bar 12 is always retained in a chain link 38 of the drive chain 18. In some embodiments, the sprocket with one tooth missing, or a truncated tooth, only allows the end piece 36 of a bar 12 to engage where that sprocket tooth is missing or truncated. In alternative embodiments, With the mechanism shown in FIG. 4, a chain guide 40 pushes the drive chain 18 out from the sprocket 20,22 so that the sprocket teeth do not interfere with the end piece 36 of the bar 12 engaging in a chain link 38 of the drive chain 18.

In mechanisms with or without connecting links 14, other spacing arrangements may be provided. In one embodiment plugs 70 such as that shown in FIG. 4, are positioned in each of the apertures of the chain links 38. The plugs 70 are preferably made of plastic and move with the chain links 38, thus preventing the end pieces 36 of the bars 12 engaging in a chain link 38. By placing the plugs 70 in every chain link 38, except the chain link apertures which are engaged by the end pieces 36 of the bars 12, the bars are spaced apart a predetermined distance as they cannot engage in chain links 38 where the plugs are located. This mechanism may provide an alternative to the escapement wheel 56 or other mechanisms that convey the bar into engagement with the drive chain 18.

Figure 12:
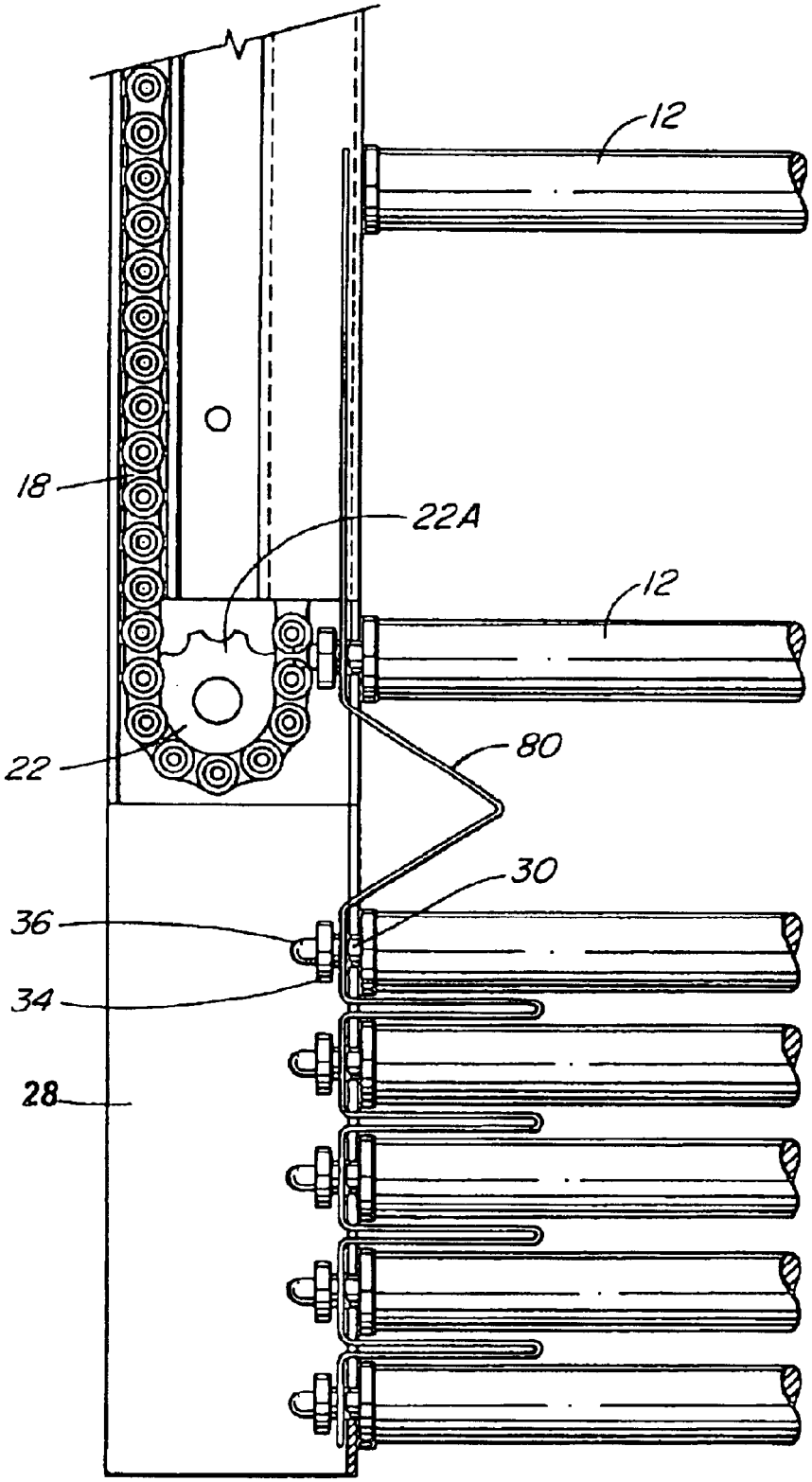
FIG. 12 is a front elevational view showing another embodiment of a security bar assembly with flexible connection spacers between adjacent bars.

Another embodiment to maintain the predetermined distance between bars and to convey the bars into engagement with the drive chain, is shown in FIG. 12. In this embodiment, the container 28 to retain the bars 12 is positioned below the opening under the second sprocket 22. Flexible connection spacers 80 are shown attached to the projections 30 at each end of all the bars 12, and may alternatively be attached at other positions on the bars 12. The spacers may determine the predetermined distance between the bars 12 when they are across the opening, and may fold as shown in FIG. 12 when the bars are moved into a storage area such as container 28 in FIGS. 11 and 12, so that bars 12 can be stored in a more compact configuration. When the first bar 12, which is never disengaged from the drive chains 18, moves up, the spacers 80 pull the adjacent bar behind it to engage in chain links of the drive assembly. This mechanism may also be adapted so that spacer tape 80 is used to pull bars 12 into engagement with chain 18 when bars 12 are stored above the chain 18. For example, when the bar storage area is above the top portion of the drive assembly, the flexible spacer 80 may be wound about rollers or guides to facilitate the transfer of bars 12 from storage into engagement with chain 18.

The sprocket 22 may be a truncated sprocket as shown in FIG. 12, that is to say, a sprocket with the tips of the teeth 22A removed. By having truncated teeth, the end pieces 36 of the bars 12 do not interfere with the teeth 22A. The truncated tooth sprocket is a further alternative to chain guide 40 or the missing tooth arrangement of FIG. 9, and the three mechanisms may be used as alternatives to other mechanisms which work as means for preventing the end pieces 36 of bars 12 from interfering with the teeth of sprocket 22.

Whereas a truncated sprocket is shown in FIG. 12 in one embodiment, a sprocket with a missing tooth as shown in FIG. 9 may be used or, alternatively, chain guides 40, as shown in FIG. 4 may be used to move the chain away from the sprocket.

Figure 13:
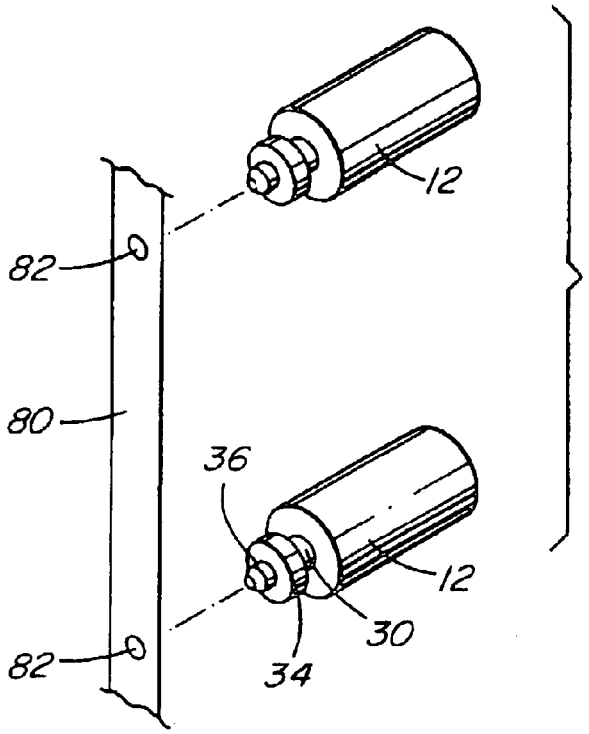
FIG. 13 is a perspective view showing tape flexible connection spacers.
Figure 14:
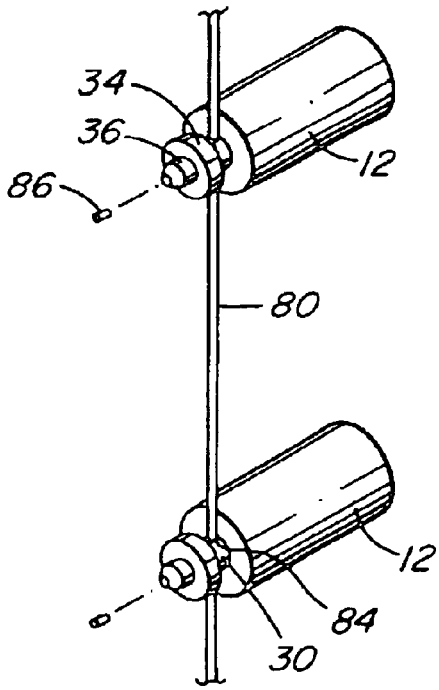
FIG. 14 is a perspective view showing cable flexible connection spacers.
Figure 15:
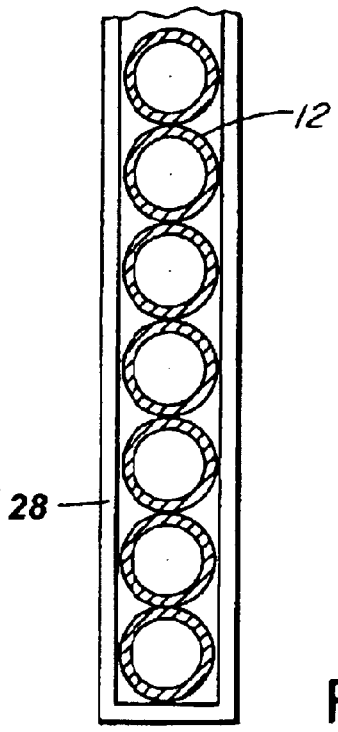
FIG. 15 is a side sectional view showing a linear container for retaining bars.
Figure 16:
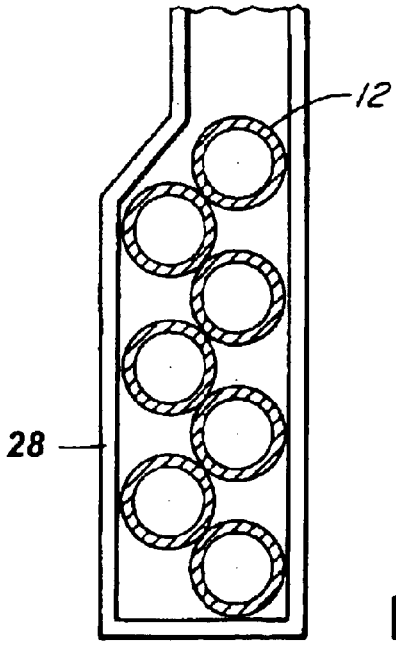
FIG. 16 is a side sectional view showing a nonlinear container for retaining bars.

As shown in FIG. 13, the flexible connection spacer 80 is a tape with holes 82 that fit over the projection 30 at the ends of the bars 12. In another embodiment separate tapes of predetermined lengths are attached between adjacent bars 12. In FIG. 14, the flexible connection spacer 80 is a cable and fits through a hole 84 in the projections 30 at the ends of the bars 12. Set screw clamps 86 through the end pieces 36 secure the cable spacer 80 to maintain the distance between the bars 12. FIG. 15 shows the container 28 shaped so that the bars 12 are positioned linearly therein. FIG. 16 shows the container 28 shaped so that the bars are positioned non-linearly. The container 28 is positioned below the opening as shown in FIG. 12.

Figure 17:
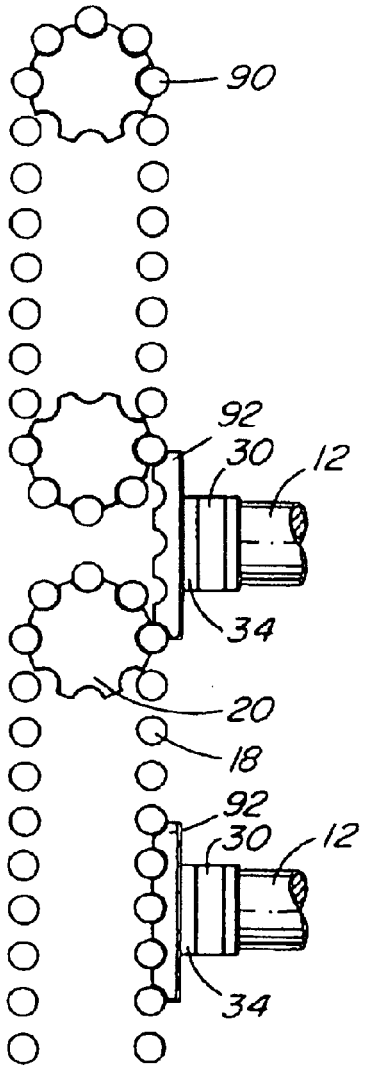
FIG. 17 is a side view showing a bar drive chain and a storage drive chain with bars spaced apart according to a further embodiment of the invention.
Figure 18:
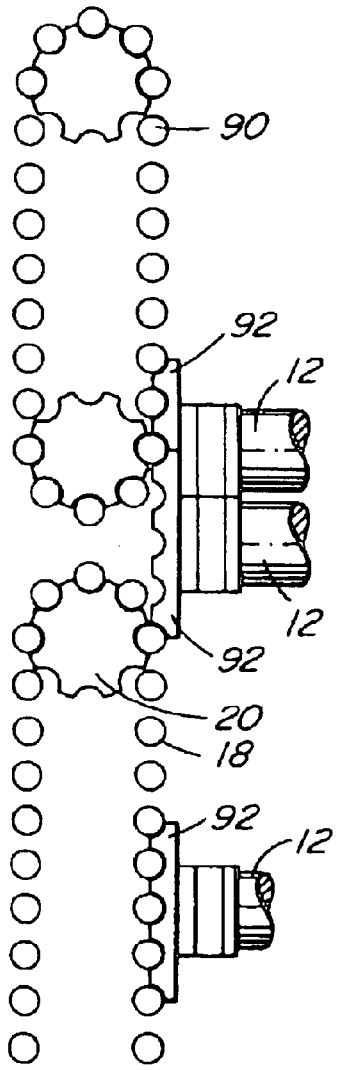
FIG. 18 is a side view similar to FIG. 17 showing two bars nestled together on the storage drive chain.
Figure 19:
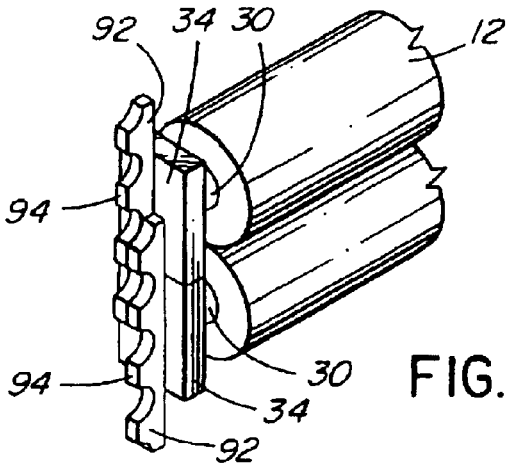
FIG. 19 is a perspective view showing two bars with elongated anchors overlapping and the bars nestled together.

In FIGS. 17, 18 and 19, another embodiment is shown which has a second set of transport mechanisms referred to as storage drive chains 90. These storage drive chains 90 are positioned in line with the bar drive chains 18 either adjacent the first sprocket 20 positioned above the opening or positioned adjacent the second sprocket 22 below the opening. In the embodiments shown, the sprockets are all truncated sprockets as shown in FIG. 12, so the sprocket teeth do not interfere with the connections between the drive chains and the bars 12. The bars 12 have projections 30 at each end to fit in side slots 32 of the channels 16 as shown in FIG. 5. Disk members 34 on the ends of the projections have elongated anchors 92 which have four protrusions 94 in line to engage in apertures of adjacent chain links 38. As shown in FIG. 19, anchors 92 may have a width less than half the width of the space between link plates in the chain link, with the anchors arranged to overlap so that adjacent bars 12 have anchors offset so that the bars can be retained together when in the container 28.

In FIG. 17 the bars 12 are shown spaced apart with a first bar having the anchor 92 spanning between the bar drive chain 18 and the storage drive chain go. When the bars 12 are moved into storage, the bar drive chain 18 moves the anchor 92 so that it engages with the storage drive chain 90, this chain is driven intermittently and it moves just sufficient for the top anchor 92 to clear the bar drive chain 18. Then, as shown in FIG. 18 the next bar 12 is moved up and the anchor 92 of the lower bar overlaps the anchor 92 of the first bar so the two bars 12 nestle together. Thus, when the bars are stored they are all nestled together on the storage drive chain 90.

To lower or raise the bars 12, depending upon whether the storage drive chain 90 is positioned above or below the opening, the storage drive chain 90 moves intermittently feeding the bars so that the anchors 92 engage into the continuously moving bar drive chain 18. The intermittent movement of the storage drive chain 90 is arranged to ensure that the space between bars, i.e., the number of chain links, is always the same across the opening.

Figure 20:
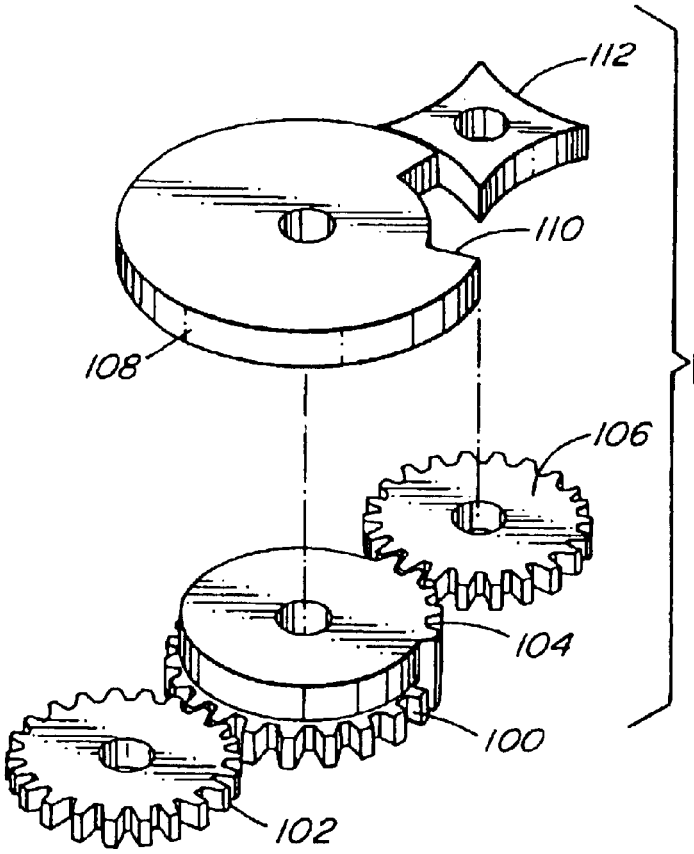
FIG. 20 is a schematic perspective view showing the intermittent drive mechanism for the storage drive chain according to an embodiment of the invention.

FIG. 20 is a schematic perspective view of the drive mechanism for the bar drive chain 18 and the storage drive chain 90 shown in FIGS. 17 and 18. An intermediate gear 100 meshes with a continuous drive gear 102 to drive the first or second sprockets 20,22 of the bar drive chain 18. An intermittent drive gear segment 104 is formed integral with the intermediate gear 100 and drives an intermittent drive gear 106 which drives the storage drive chain 90. An intermittent lock wheel 108 is keyed to the intermediate gear 100 and has a cutout 110, which is positioned above the intermittent drive gear segment 104. A locking dog 112 is attached to the intermittent drive gear 106 and only permits the intermittent drive gear 106 to rotate when the intermittent drive gear segment 104 meshes with the intermittent drive gear 106. At all other times the intermittent gear locking dog 112 cannot rotate as it is prevented by the periphery of the locking wheel 108.

Anchors 92 may also be adapted to fit against a splined drive shaft (or screw rod), and may be of variable length. Splined drive shafts or screw rods may also be used in a variety of ways as alternative mechanisms for driving a chain. For example, a splined shaft may be used to turn a drive sprocket that also engages a drive chain. Alternatively, a drive chain may be adapted with chain link side plates that have teeth that directly engage a threaded shaft, so that in one embodiment the drive chain may for example engage the threaded shaft on one side of the chain and engage bar ends on the other side of the chain. Such arrangements may also be adapted to drive storage chains.

The drive mechanisms as described herein may include a brake, which may for example be included with the motor so the bars 12 cannot be shifted when the bars are stopped.

In alternative embodiments a manual rotating crank arm (not shown) may be provided so that if there is power failure the bars 12 can be either lowered or raised manually simply by rotating the drive shaft 52.

Furthermore, for emergencies, a clutch or release pin may be included in the powertrain of the drive mechanism to disengage the gear motor from the drive shaft 52. This allows the bars 12 to be pushed up or down as the drive chains 18 move freely. The drive chains 18 rotate on the sprockets 20,22 and when each horizontal bar comes to the ends of the drive chains 18 it disengages from the drive chains 18 and either falls onto the floor or, alternatively, falls into a container depending upon the particular embodiment provided, thus providing an escape opening for an emergency. The security bar assembly is preferably placed on the inside of a building as intruders are not easily able to get at the operating mechanism.

Figure 24:
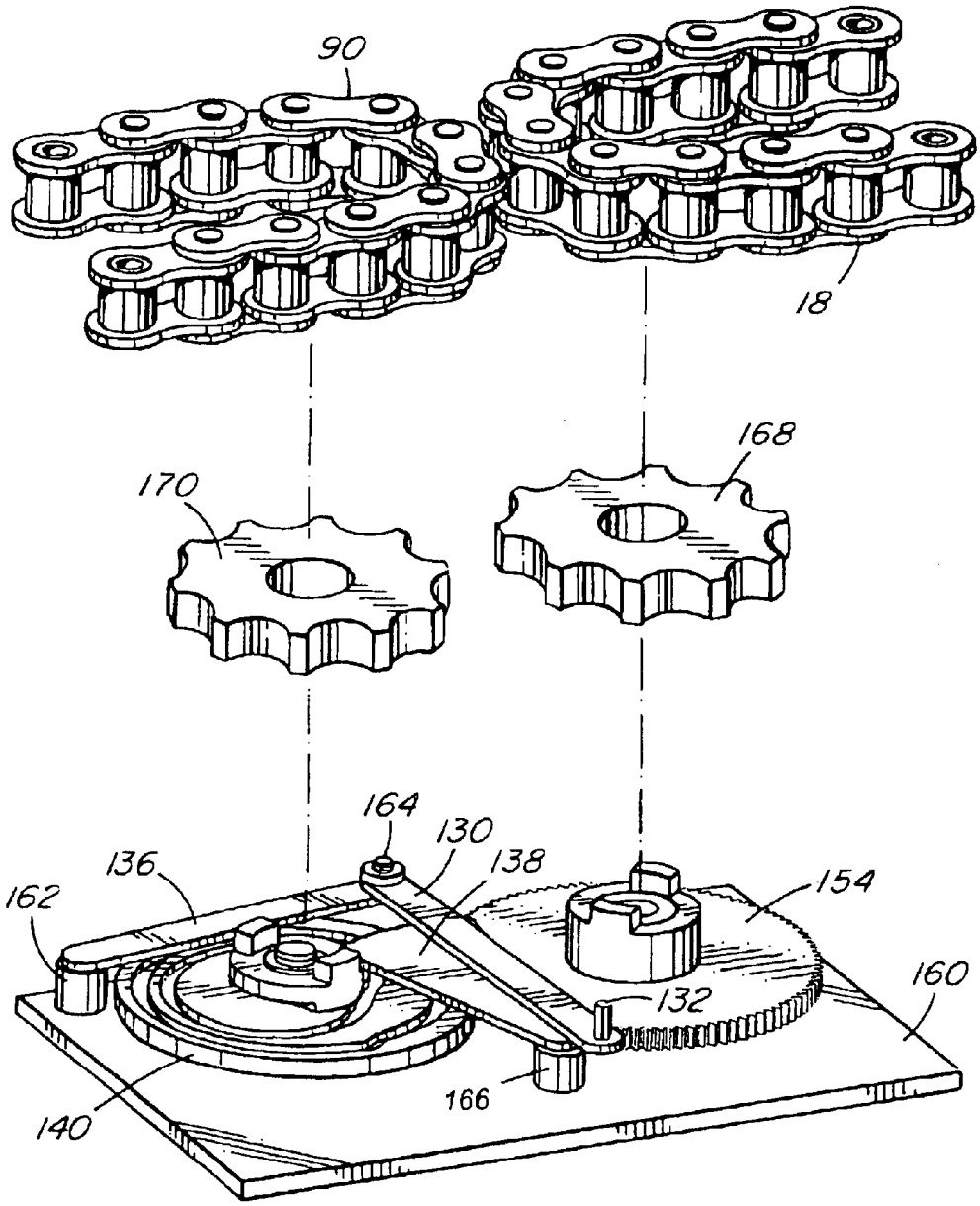
FIG. 24 is an isometric view of the bar transfer mechanism shown in FIG. 23, showing an exploded view of the partially broken away sprockets and chains of the drive chain and the storage drive chain.
Figure 25:
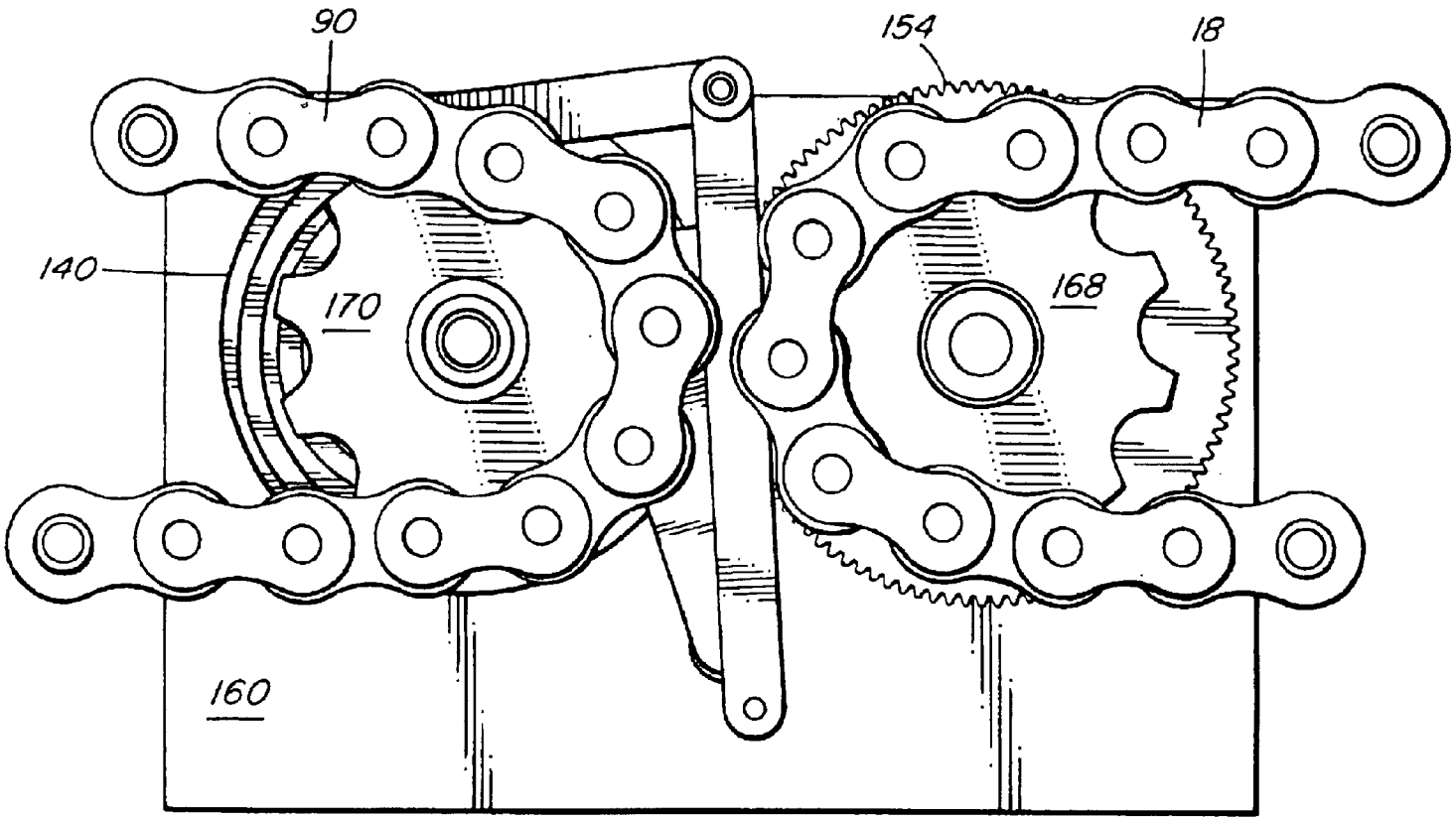
FIG. 25 is an elevational view, showing the bar transfer mechanism of FIG. 23, illustrating the relationship of the mechanism with a storage drive chain and a bar drive chain and the respective sprockets.
Figure 26:
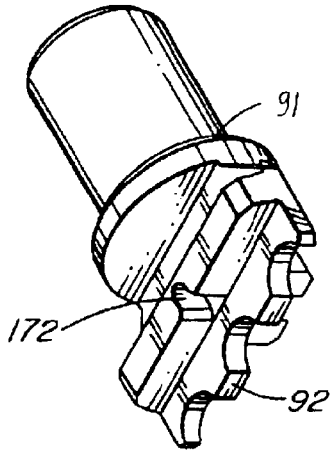
FIG. 26 is an isometric view showing the top of a bar end with an elongated anchor for engaging a chain and a feed slot for engaging a feed pin of a bar transfer mechanism.
Figure 28:
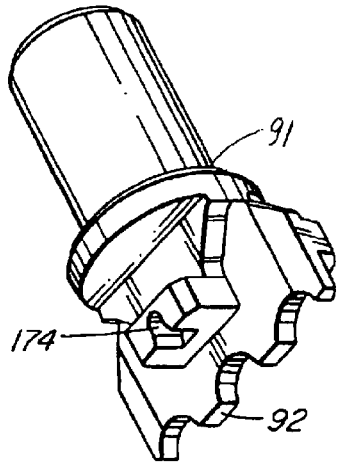
FIG. 28 is an isometric view showing the bottom of the bar end of FIGS. 26 and 27, showing the difference in construction of the feed slot on the bottom of the bar end compared to the top of the bar end.
Figure 27:
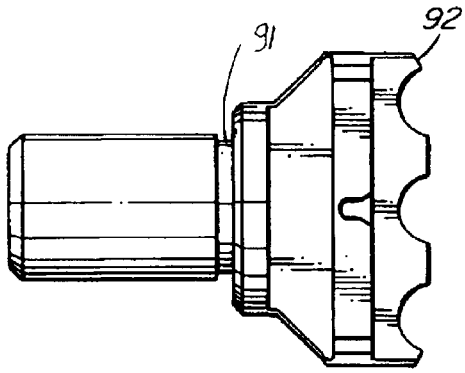
FIG. 27 is a top plan view of the bar end of FIGS. 26 and 28.
Figure 29:
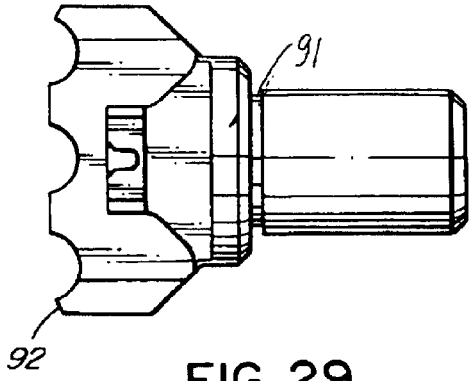
FIG. 29 is a bottom plan view of the bar end of FIGS. 26 and 28.

FIGS. 23 through 29 illustrate an alternative embodiment of a transfer mechanism for transferring bars 12 between drive chain 18 and storage chain 90. In the illustrated embodiment, transfer arm 130 is provided with a transfer arm pin 132 which in operation moves about a rotational path, shown by dotted lines 134. Transfer arm pin 132 engages a bar end, as shown in FIGS. 26 through 29, to transfer a bar 12 from drive chain 18 to storage drive chain 90. The motion of transfer arm pin 132 along path 134 is actuated by a mechanism comprising transfer arm 130, lever arm 136 and lifting arm 138. Lever arm 136 is pivotably connected to back plate 160 at lever arm mount 162, and is pivotably connected to transfer arm 130 at arm joint 164. Lifting arm 138 is pivotably connected to back plate 160 by lifting arm mount 166. Arms 130, 136 and 138 are in turn actuated by cam wheel 140. Outer groove 142 in cam wheel 140 accommodates lever arm pin 146 provided on lever arm 136, so that rotation of cam wheel 140 moves lever arm 136 as lever arm pin 146 travels in outer groove 142. Similarly, inner groove 144 accommodates lifting arm pin 148 provided on lifting arm 138, so that rotation of cam wheel 140 moves lifting arm 138 as lifting arm pin 148 travels in outer groove 142. The motion of lifting arm 138 is communicated to transfer arm 130 by transfer arm pin 150 which travels in lifting arm groove 152. Cam wheel 140 is driven by drive wheel gear 154 via transfer gear 156, shown in phantom in FIG. 23. Cam wheel 140 may be adapted to drive storage drive chain 90, and drive wheel gear 154 may be adapted to drive drive chain 18, as shown in FIG. 24, which shows drive chain sprocket 168 and storage chain sprocket 170 in exploded view.

FIGS. 26 through 29 illustrate a bar end having elongated anchors 92, for engaging drive chain 18 and storage chain 90. As an alternative to the chain transfer mechanism illustrated in FIGS. 17 and 18, the bar ends of FIGS. 26 through 29 are adapted for use with the chain transfer mechanism of FIGS. 23 through 25. To engage transfer arm pin 132, the bar ends are provided with a top feed slot 172 and a bottom feed slot 174, each of which are adapted to be engaged by transfer arm pin 132 to carry bar 12 between storage drive chain 90 and bar drive chain 18, in either direction.

Bar ends, such as those shown in FIGS. 26 through 29, may slidably engage bars 12, such as the tubular bars shown in FIG. 9. In such embodiments, a shaft portion 91 of the bar ends may be elongated, to facilitate a telescoping extensible engagement between the bar end and bar 12, so that the engagement between the bar end and the channel in which it runs may be preserved even when the distance between channels varies, such as in an opening of uneven width, or in the event that a bar is bent. Bar ends may also be provided with adaptations such as ribs, teeth, protrusions, burrs or detents to strengthen the engagement between slidable bar ends and bars 12, as shown in FIG. 5. The mechanism to provide engagement between the bar ends and the bars may be adapted so that the bar ends are relatively free to move in the bars unless the bar is bent, in which case the bar end engagement mechanism may act to resist slidable movement of the bar ends in the bars. For example, ribs or teeth as shown in FIG. 5 may be sized so that they do not strongly engage the bar unless the bar is bent so that it meets the bar end at an angle, in which case the ribs will more forcefully engage the bars.

Figure 30:
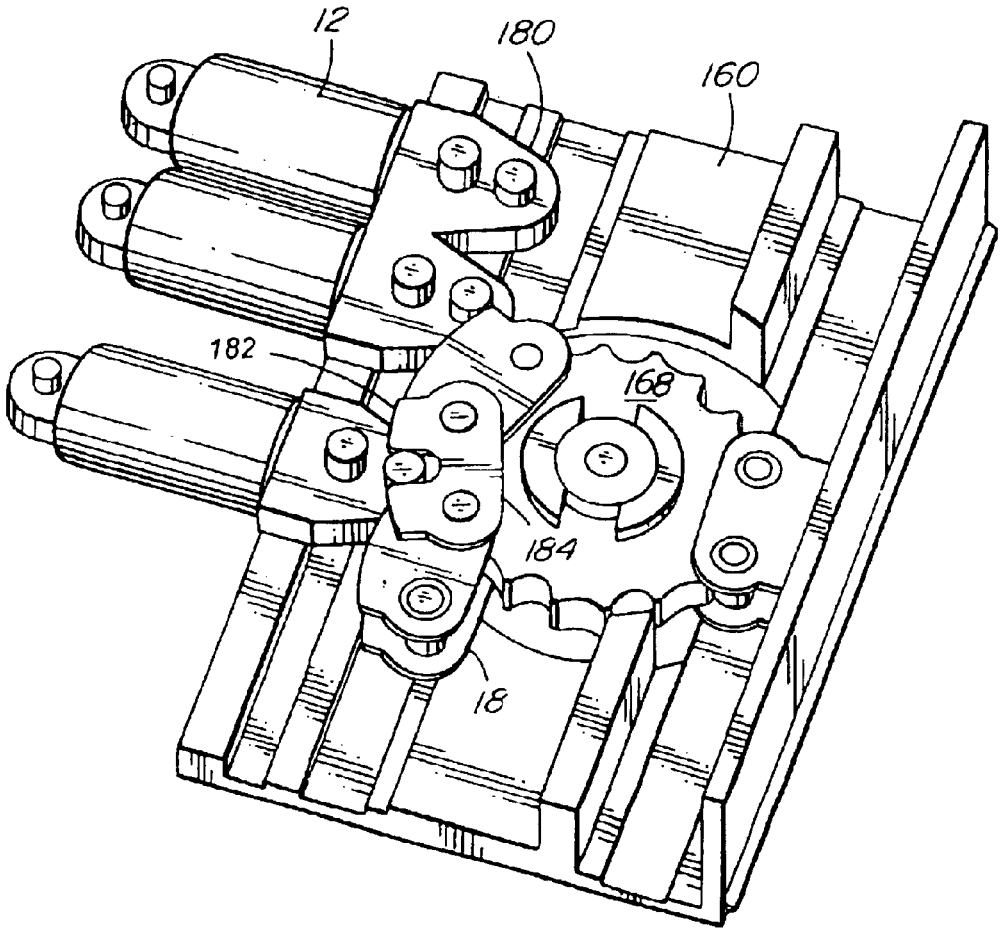
FIG. 30 is an isometric view of an alternative bar transfer mechanism, showing chain links having curved outside edges to function as cam-like side plates, wherein some of the chain links include a recess for engaging a pin on a bar end.

FIG. 30 shows an alternative configuration for the links in drive chain 18, in which cam-like side plates 182 of each link have convex arcuate conformations, which form a smooth exterior curved surface as drive chain 18 moves around drive sprocket 168. In such an embodiment, periodic links may be provided in which cam-like side plates 182 are provided with a recess 184 that is adapted to accommodate side pins 180 on the bar ends. In operation, as drive chain 18 travels around drive sprocket 168, with bars 12 stacked above drive sprocket 168, bars 12 will periodically be admitted to engagement with drive chain 18 when a recess 184 becomes available to accommodate a side pin 180. Side pins 180 may be rotatable to facilitate movement against cam-like side plates 182. Similarly, channel pins 181 may be rotatable to facilitate movement against the inner walls of channels 16.

Figure 31:
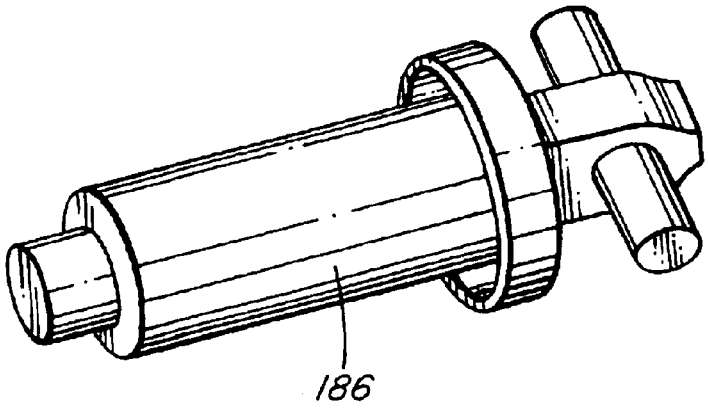
FIG. 31 shows an alternative embodiment of a bar end, having a single pin.
Figure 32:
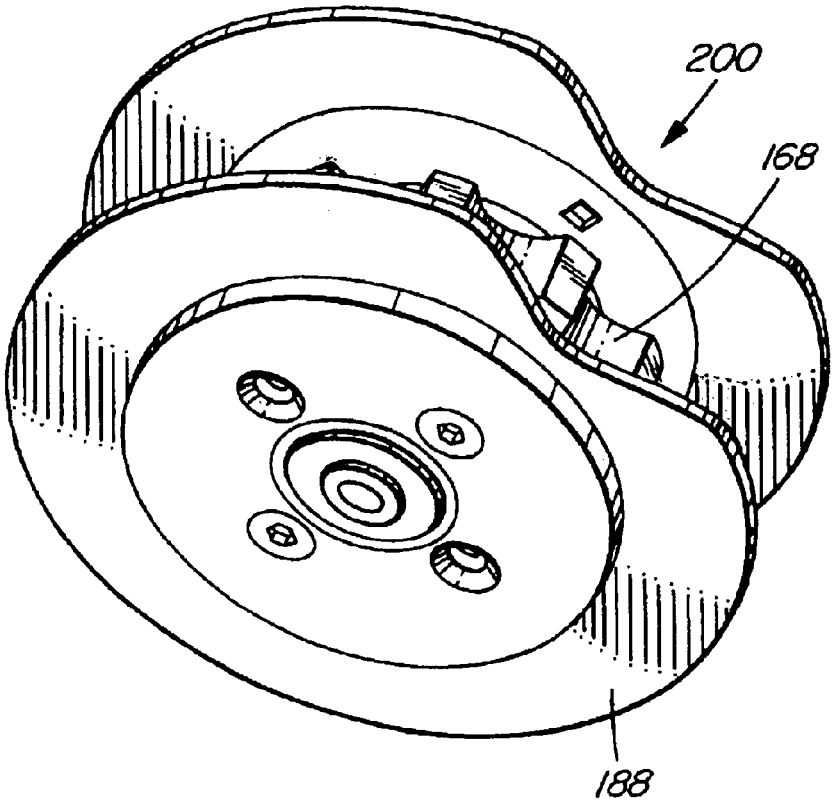
FIG. 32 shows an alternative embodiment of part of a bar transfer mechanism, having two plates on either side of a chain drive sprocket, each plate having a recesses adapted for feeding a bar end on to a chain.

In alternative embodiments, as for example shown in FIG. 32, one or more cam(s) may be attached to drive sprocket 168, wherein the side cam(s) 188 has a recess 200 analogous to recess 184 so that side cam(s) 188 functions in the same way as cam-like side plates 182 to achieve the same result of admitting bars 12 into engagement with drive chain 18 (somewhat analogous to the function of notch 58 in escapement wheel 56 shown in FIG. 11). The geometry of recess 184, or recess 200 in side cam(s) 188, may be varied to facilitate handling of side pin 180. In an alternative embodiment, as shown in FIG. 31, a single bar end pin 186 may function in a similar manner to both side pin 180 and channel pin 181. It will be appreciated that sprocket 168 and side cam(s) 188 may be arranged at a variety of angles with respect to bars 12, such as at right angles, similar to the arrangement shown in FIG. 11.

Figure 22:
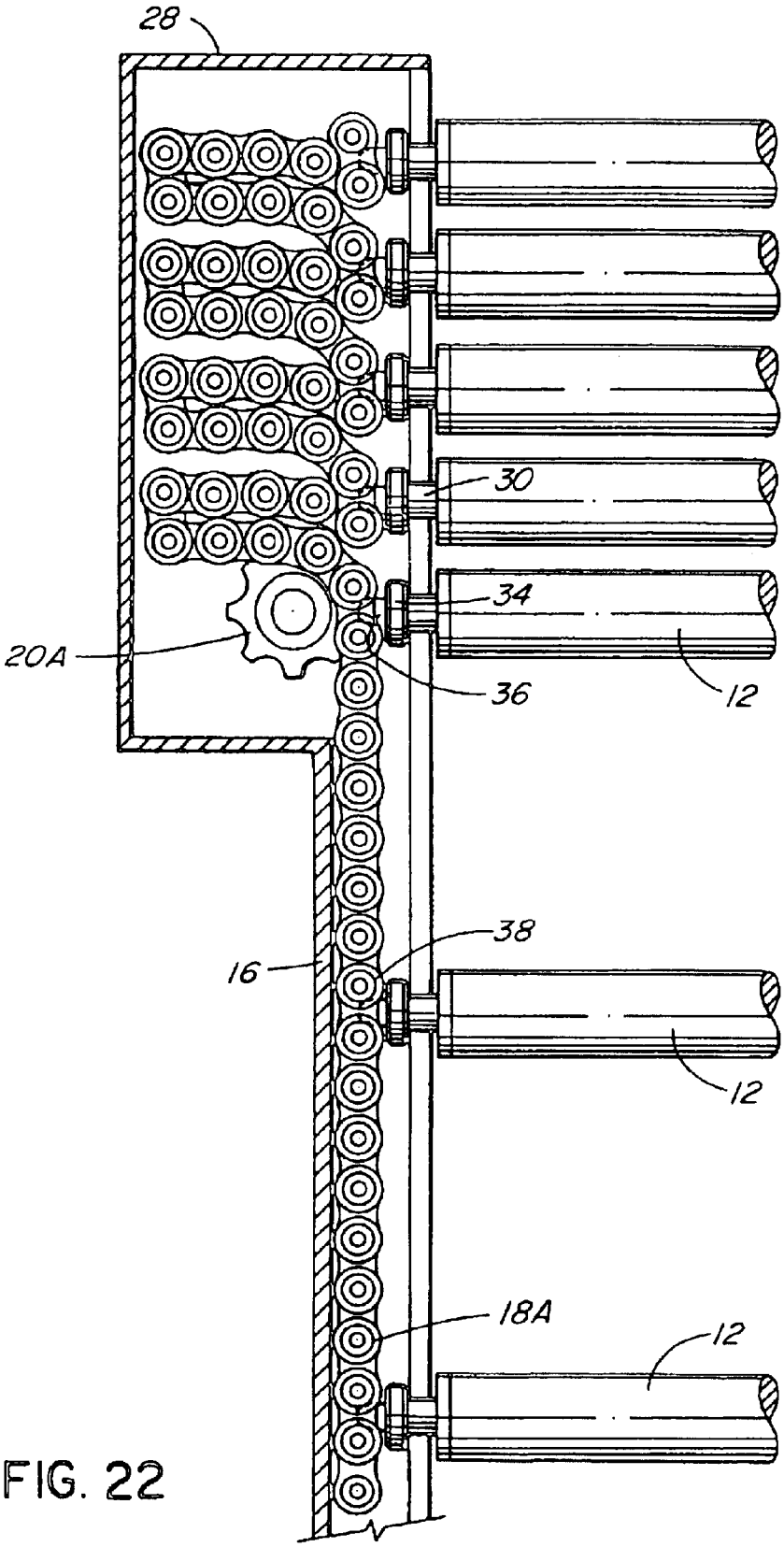
FIG. 22 is a detailed sectional front view showing a drive chain, which is not endless, having bar ends attached to chain links in the drive chain, the drive chain and bars being retained in a storage area positioned substantially adjacent the opening when the bars are not in place over the opening.
Figure 23:
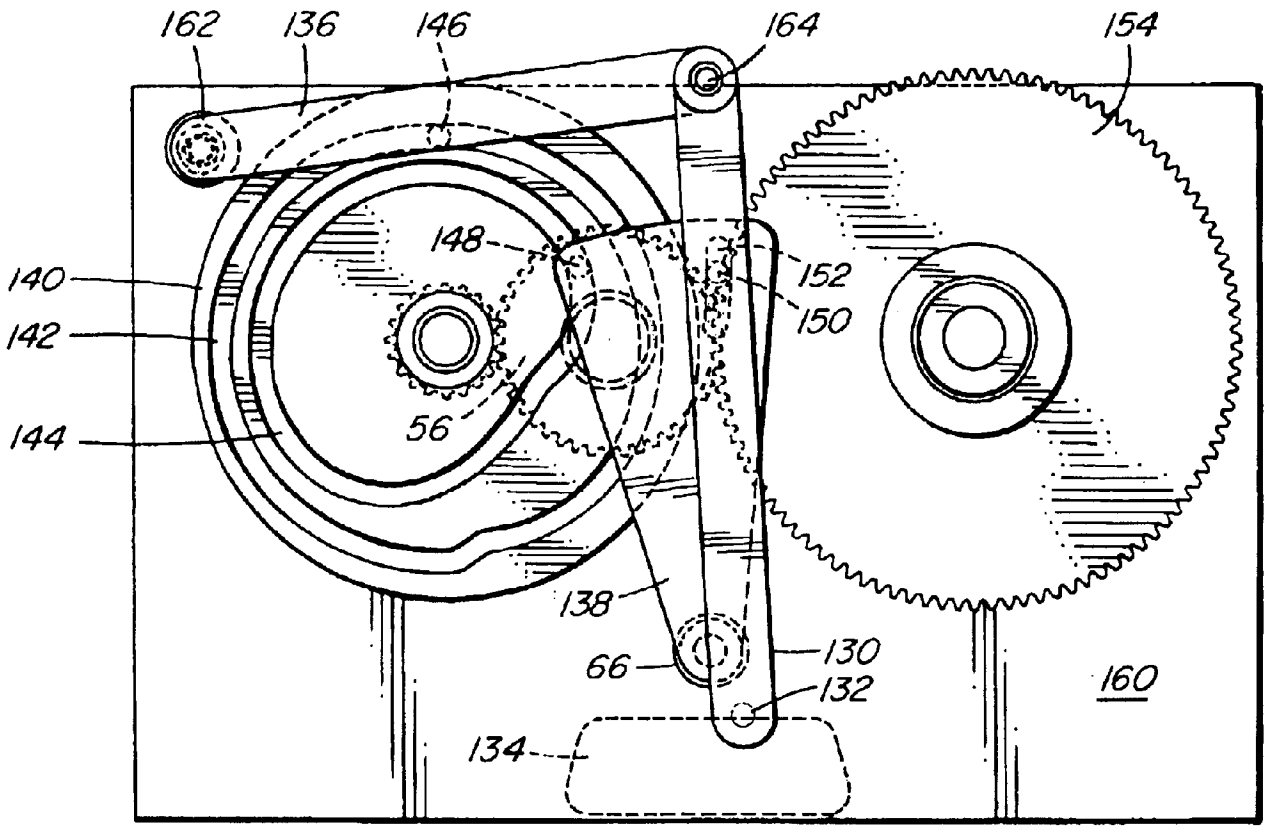
FIG. 23 is a plan view showing a bar transfer mechanism for transferring bars from a drive chain to a storage drive chain.

As shown for example in FIG. 9 or 22, each bar 12 may be separately engaged by the transport mechanism, or, as illustrated in FIG. 1, the driven movement of one or more bars may be communicated to other bars not attached directly to the transport mechanism by links 14 between bars. In alternative embodiments, links 14 may be interconnected in a scissored arrangement, in which links 14 are pivotally connected to one another and may slidably connect to bars 12, so that links 14 adapt to variable spacing between bars 12. In further alternatives, bars 12 may take the form of an articulated interconnection of many links, for example in a scissored pivotal arrangement that facilitates expansion of the interconnected link arrangement to cover an opening.

Figure 21:
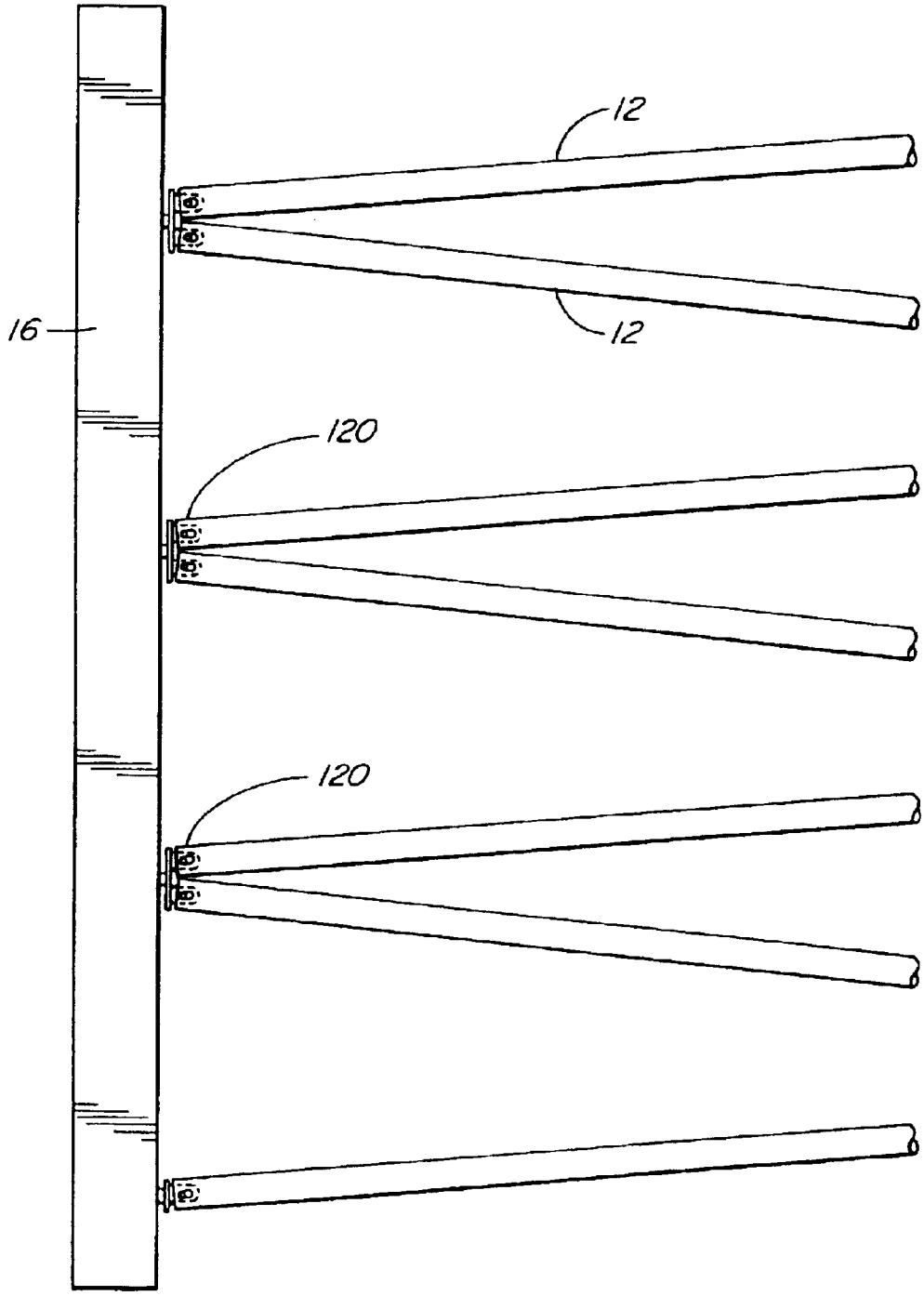
FIG. 21 is a partial front elevational view showing yet a further embodiment of the present invention wherein the bars are angled across the opening.

FIG. 21 shows a security bar assembly wherein the ends of the bars 12 are connected together with a pivotal sliding bar attachment 120 that can have a single pin assembly for connecting to a chain link 38 as shown in FIG. 4, or a multiple connection as shown in FIG. 6. This permits the bars 12 to be zig-zagged across the opening.

Whereas the drive chains 18 shown in the other Figures have been shown rotating about first sprocket 20 and second sprocket 22, in FIG. 22 there is shown a drive chain 18A which is not endless. A single drive sprocket 20A is positioned at the top of the channel 16 and the drive chain 18A has the end pieces 34 of the bar permanently attached to chain links 38 spaced a predetermined number of links apart. The sprocket 20A is a truncated sprocket so the teeth do not interfere with the end pieces 36 of the bars 12. When the bars 12 are moved up into the storage area 28 the intermediate chain links of the drive chain 18A fold up as shown in the Figure, so that the bars 12 are stored as close together as possible. The sprocket 20A pulls the drive chain 18A down, feeding the bars 12 across the opening and providing the spacing between the bars 12.

The security bar assembly may be provided with a cloth covering. The cloth covering may be retractable, for example, by being rolled on a spring-actuated shaft, with the ends of the covering adapted to connect to the distal portion of the security bar assembly, for example by hooks. Alternatively, the cloth may be provided in or around the bars 12. For example, bars 12 may be threaded through pockets in the cloth, so that the cloth provides a screen that does not allow one to look through the security bar assembly.

Various changes may be made to the embodiments shown herein without departing from the scope of the present invention which is limited only by the following claims.

What is claimed is:

1. A security bar assembly for an opening, comprising a plurality of bars extending between first and second channels, the first and second channels being positioned one on each of a first and second opposing side of the opening, the bars having bar ends connected to transport mechanisms for movement in each channel, wherein the channels each comprise a drive mechanism for independently driving each transport mechanism for moving the bar ends in each channel, and the drive mechanism in each of the first and second channels is independently driven respectively by first and second motors, and wherein the first and second motors are synchronised by a non-mechanical communication link.

2. The security bar assembly of claim 1, wherein the bar ends are retained in the channels.

3. The security bar assembly of claim 1, wherein the drive mechanisms are enclosed in the channels.

4. The security bar assembly of claim 1, wherein the transport mechanisms are enclosed in the channels.

5. The security bar assembly of claim 1, wherein the bar ends are slidably mounted in the bars so that the bar ends may slide along the longitudinal axis of the bars.

6. The security bar assembly of claim 5, wherein the bar ends are provided with teeth that engage the bars when the bars are bent, to resist slidable movement of the bar ends in the bars when the bars are bent.

7. The security bar assembly of claim 1, wherein the opposing bar ends of each bar each engage the transport mechanisms.

8. The security bar assembly of claim 1, further comprising a storage area for storing bars that are not in place over the opening, and a transfer mechanism for moving the bars from the storage area into engagement with the transport mechanisms.

9. The security bar assembly of claim 8, wherein the transfer mechanism comprises a cam supporting the bar ends and having a recess adapted for accommodating a bar end to feed the bar end on to the transport mechanisms.

10. The security bar assembly of claim 9, further comprising a plate, wherein the plate is attached to a sprocket, the sprocket engages a drive chain forming a part of the transport mechanism and the bar ends engage the drive chain when the bars are in place over the opening.

11. The security bar assembly of claim 1, wherein each transport mechanism comprises a threaded shaft and the bar ends threadably engage the threaded shaft so that the bars are moved by rotation of the threaded shaft.

12. The security bar assembly of claim 1, wherein each drive mechanism comprises a threaded rod, a drive chain sprocket linked to the threaded rod and driven by rotation of the threaded rod, and a drive chain driven by the drive chain sprocket, wherein the bar ends engage the drive chain whereby the bars are moved by rotation of the threaded rod.

13. The security bar assembly of claim 1, further comprising links connecting the bars, wherein at least one end of a link is pivotally connected to a bar.

14. The security bar assembly of claim 1, wherein the plurality of bars is driven by a bar drive chain and a storage drive chain, the security bar assembly further comprising a transfer mechanism comprising a transfer arm for moving bars between the bar drive chain and the storage drive chain.

15. The security bar assembly of claim 14 wherein the transfer mechanism further comprises a transfer arm pin provided on the transfer arm to engage a bar end to transfer the bar end from the bar drive chain to the storage drive chain.

16. The security bar assembly of claim 14 wherein the transfer mechanism further comprises a cam wheel operably linked to the transfer arm to actuate the transfer arm.

17. The security bar assembly of claim 16 wherein the transfer mechanism further comprises a lever arm and a lifting arm, wherein the lever arm and the lifting arm are driven by engagement with the cam wheel, and wherein the transfer arm is operably connected to the lever arm and the lifting arm.

18. The security bar assembly of claim 17 wherein the transfer mechanism further comprises:

a lever arm pin provided on the lever arm and accommodated in a lever arm groove of the cam wheel;

a lifting arm pin provided on the lifting arm and accommodated in a lifting arm groove of the cam wheel; and an actuating pin provided on the transfer arm and accommodated in a lifting arm groove on the lifting arm;

wherein, the rotation of the cam wheel moves the lever arm, the lifting arm and the transfer arm.

19. The security bar assembly of claim 18 wherein:

the lever arm may be pivotably connected to a back plate and pivotably connected to the transfer arm; and the lifting arm may be pivotably connected to the back plate.

20. The security bar assembly of claim 16, wherein the transfer mechanism is operably connected to the bar drive chain and storage drive chain, so that the transfer mechanism is driven with the bar drive chain and storage drive chain.

21. A transfer mechanism for a security bar assembly, wherein the security bar assembly comprises security bars driven by a bar drive chain, wherein the transfer mechanism comprises cam-like side plates on the bar drive chain, and at least one of the cam-like side plates are adapted to engage a security bar.

22. The transfer mechanism of claim 21, wherein the cam-like side plates are capable of an external convex arcuate conformation for bearing on a side pin on the security bar, and wherein periodic cam-like side plates are provided with a recess adapted to accommodate the side pins on the security bar to admit the security bar to engagement with the drive chain.

23. A security bar assembly for an opening, comprising a plurality of bars extending between first and second channels, the first and second channels being positioned one on each of a first and second opposing side of the opening, the bars having bar ends connected to transport mechanisms for movement in each channel, further comprising a storage area for storing bars that are not in place over the opening, and a transfer mechanism for moving the bars from the storage area into engagement with the transport mechanisms, wherein the transfer mechanism comprises a cam supporting the bar ends and having a recess adapted for accommodating a bar end to feed the bar end on to the transport mechanisms.

24. The security bar assembly of claim 23, wherein the cam is attached to a sprocket, the sprocket engages a drive chain forming a part of the transport mechanism and the bar ends engage the drive chain when the bars are in place over the opening.

25. The security bar assembly of claim 1, 15, or 23 wherein the bar end slidably engages the bar.

26. The security bar assembly of claim 25 further comprising a shaft connecting the bar end to the bar in telescoping extensible engagement.

27. The security bar assembly of claim 2, wherein the drive mechanisms are enclosed in the channels.

28. The security bar assembly of claim 2 wherein the transport mechanisms are enclosed in the channels.

29. The security bar assembly of claim 3, wherein the transport mechanisms are enclosed in the channels.

30. The security bar assembly of claim 1 wherein at least one of the bars has a length and the length is adjustable.

31. A security barrier comprising the security bar assembly of claim 1.

32. The security barrier of claim 31 wherein said barrier comprises at least two adjacent security bar assemblies, and said assemblies are non-linearly arranged.

* * * * *